US005505031A

United States Patent [19]

Heydon

[11] Patent Number: 5,505,031

[45] **Date of Patent: * Apr. 9, 1996**

[54] BUILDING STRUCTURE AND METHOD OF USE

[75] Inventor: John J. Heydon, Big Bear Lake, Calif.

[73] Assignee: Heydon Building Systems, Inc. of California, Tucson, Ariz.

[ * ] Notice: The portion of the term of this patent subsequent to Jan. 18, 2001, has been disclaimed.

[21] Appl. No.: 238,757

[22] Filed: May 4, 1994

Related U.S. Application Data

[63] Continuation-in-part of Ser. No. 897,909, Jun. 12, 1992, Pat. No. 5,353,560.

[51] Int. Cl.[6] ..... E04B 2/00

[52] U.S. Cl. ..... 52/281; 52/241; 52/474; 52/270; 52/284; 52/790.1; 52/794.1; 52/797.1; 52/800.1

[58] Field of Search ..... 52/167.3, 241, 52/264, 270, 281, 286, 763, 781.3, 657, 698, 745.1, 309.7, 779, 474, 790.1, 793.1, 794.1, 797.1, 800.1, 745.65

[56] References Cited

U.S. PATENT DOCUMENTS

| | | | |
|---|---|---|---|
| 634,562 | 10/1899 | Pagnon . | |
| 710,830 | 10/1902 | Zimmerman et al. . | |
| 776,419 | 11/1904 | Platt . | |
| 903,734 | 11/1908 | Larsen . | |
| 904,588 | 11/1908 | Wightman . | |
| 994,027 | 5/1911 | O'Beirne . | |
| 1,056,810 | 3/1913 | McDonald . | |
| 1,100,531 | 6/1914 | Cahill . | |
| 1,106,584 | 8/1914 | Robbins . | |
| 1,130,722 | 3/1915 | Fletcher . | |
| 1,226,214 | 5/1917 | Hopkins . | |
| 1,345,156 | 6/1920 | Flynn . | |
| 1,364,880 | 1/1921 | Jester . | |
| 1,673,118 | 6/1928 | Lawrence | 52/781.3 X |
| 1,785,067 | 12/1930 | Bemis . | |
| 1,810,891 | 6/1931 | Bemis . | |
| 1,850,118 | 3/1932 | Meyers | 52/657 X |
| 1,900,767 | 3/1933 | Ryan . | |
| 1,924,724 | 8/1933 | Olney . | |
| 1,958,771 | 5/1934 | Simons . | |
| 1,962,514 | 6/1934 | MacWilliam . | |
| 1,970,414 | 8/1934 | Brown . | |
| 1,995,264 | 3/1935 | Mason . | |
| 2,025,529 | 12/1935 | Scudder . | |
| 2,077,750 | 4/1937 | Fish . | |
| 2,114,388 | 4/1938 | Killion . | |

(List continued on next page.)

FOREIGN PATENT DOCUMENTS

| | | |
|---|---|---|
| 1342059 | 1/1963 | France . |

OTHER PUBLICATIONS

Building Systems, Covington's Therml–Impac Panel 17 pages.
Fine Homebuilding—Sep. 1990—by "Foam–Core Panels" by S. Andrews 7 pages.
R Control Structural Building Panel; 8 pages.
NASCOR; 4 pages.
NASCOR System—4 pages.
News Analysis by M. Coleman "New Standard . . . Walls" Nov.–Dec. 1993 2 pages.
5 pages re Energy conservation.

*Primary Examiner*—Robert J. Canfield
*Attorney, Agent, or Firm*—Stetina Brunda & Buyan

[57] ABSTRACT

An improved building structure and method of use comprising separately fabricated floor, wall and ceiling structures capable of withstanding shear and seismic forces. The wall structure comprises an elongate track and a plurality of posts rigidly attached to a foundation structure of the building. Disposed between the posts are a plurality of interlocking foam wall sections which encapsulate the posts of the wall structure. Attached to the top ends of the posts are upper and lower header beams which serve as a support structure for the roof and ceiling structures. Brace members are attached to the posts and header beam to provide the wall structure with increased seismic stability.

46 Claims, 7 Drawing Sheets

U.S. PATENT DOCUMENTS 2,077,750 4/1938 Fish .
2,114,388 4/1938 Killion .
2,126,511 8/1938 Soule ..... 52/657 X
2,177,699 10/1939 Fisher .
2,181,698 11/1939 Langenberg .
2,249,203 7/1941 Guignon, Jr. .
2,275,109 3/1942 McGee .
2,290,339 7/1942 Leach .
2,301,306 11/1942 McDonald .
2,302,101 11/1942 Boydstun ..... 52/657 X
2,351,615 6/1944 James .
2,465,687 3/1949 Jacobsen .
2,505,902 5/1950 Madger .
2,523,920 9/1950 Piatt .
2,647,392 8/1953 Wilson .
2,669,861 2/1954 Clutter .
2,856,039 10/1958 Hawkinson .
2,883,852 4/1959 Midby .
2,938,376 5/1960 Workman et al. .
2,966,708 1/1961 Freeman, Jr. .
3,113,401 12/1963 Rose .
3,120,031 2/1964 Bohnsack .
3,138,898 6/1964 Carter .
3,147,336 9/1964 Mathews .
3,160,280 12/1964 Burch .
3,186,130 6/1965 Gray .
3,228,158 1/1966 Russell .
3,255,562 6/1966 Altschuler .
3,331,173 7/1967 Elsner .
3,343,314 9/1967 Smith .
3,353,315 11/1967 Barker .
3,410,044 11/1968 Moog .
3,411,252 11/1968 Boyle, Jr. .
3,420,023 1/1969 Gregori .
3,449,878 6/1969 Hern .
3,462,897 8/1969 Weinrott .
3,552,076 1/1971 Gregori .
3,667,180 6/1972 Tischuk .
3,712,004 1/1973 Loebsack .
3,733,755 5/1973 Butler .
3,784,312 1/1974 Gordon .
3,788,020 1/1974 Gregori .
3,791,082 2/1974 Bowling .
3,807,112 4/1974 Perina .
3,841,043 10/1974 Zinn .
3,927,498 12/1975 Benedetti .
3,964,228 6/1976 Nilsen .
3,992,844 11/1976 Gretter .
4,019,298 4/1977 Johnson, IV .
4,089,144 5/1978 Astl .
4,147,004 4/1979 Day et al. .
4,180,956 1/1980 Gross .
4,223,501 9/1980 DeLozier .
4,242,390 12/1980 Nemeth .
4,263,765 4/1981 Maloney .
4,416,097 11/1983 Weir .
4,439,967 4/1984 Dielenberg .
4,614,013 9/1986 Stevenson .
4,614,071 9/1986 Sams et al. .
4,633,634 1/1987 Nemmer et al. .
4,641,468 2/1987 Slater .
4,672,785 6/1987 Salvo .
4,706,429 11/1987 Young .
4,747,245 5/1988 Lesmeisler et al. ..... 52/309.7
4,774,794 8/1988 Grieb .
4,813,193 3/1989 Altizer ..... 52/309.7 X
4,833,855 5/1989 Winter, IV .
4,854,096 8/1989 Smolik .
4,894,969 1/1990 Horobin .
4,981,003 1/1991 McCarthy .
5,003,742 4/1991 Dettbarn .
5,203,132 4/1993 Smolik .
5,279,088 1/1994 Heydon .
5,353,560 10/1994 Heydon ..... 52/241 X

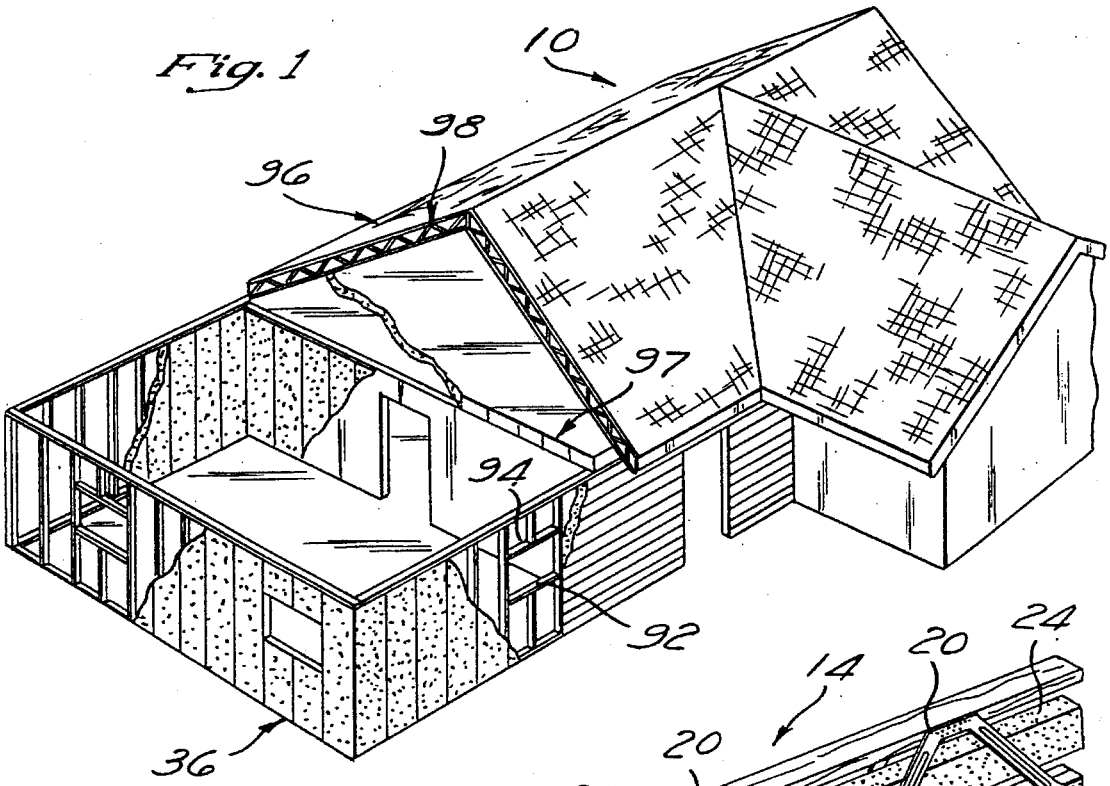
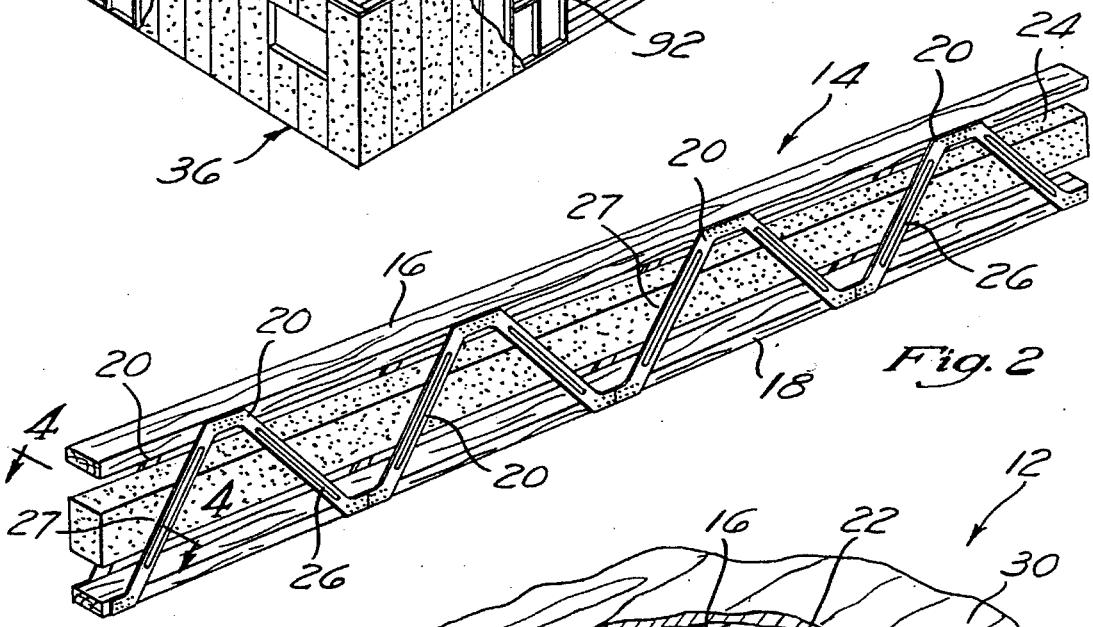
Fig. 2
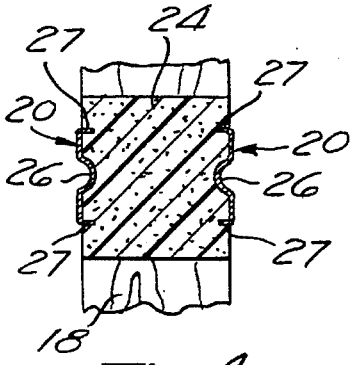
Fig. 4
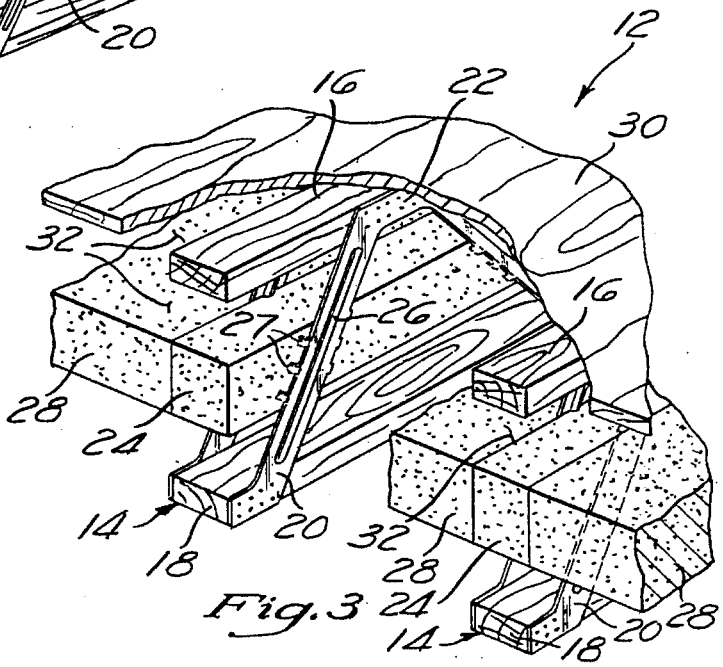
Fig. 3

74

36
72
26
46
76
78
50
52
40
30
48

58
62
42
60
79
56
75

44
54
83

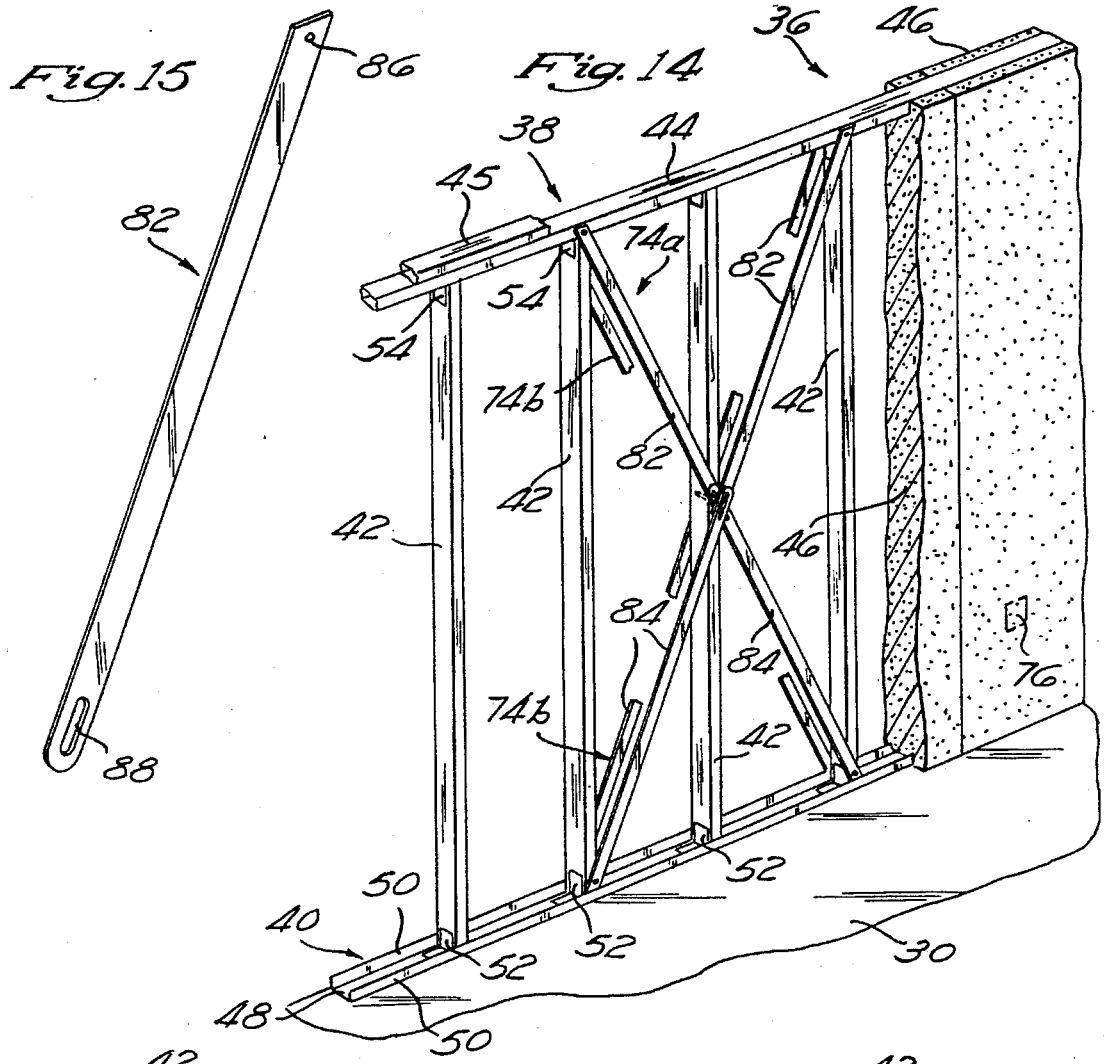
Fig. 15
86
82
88
Fig. 14
36
46
38
44
45
74a
82
54
54
74b
42
82
42
42
46
84
84
76
74b
42
52
50
40
52
52
30
48
50
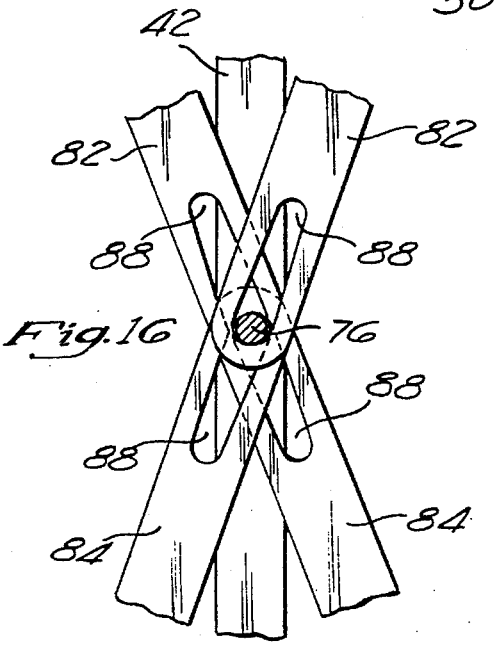
42
82
82
88
88
Fig. 16
76
88
88
84
84
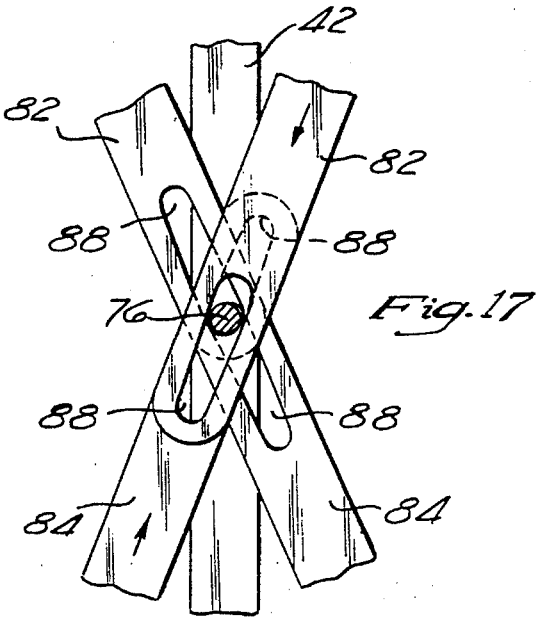
42
82
82
88
88
76
Fig. 17
88
88
84
84

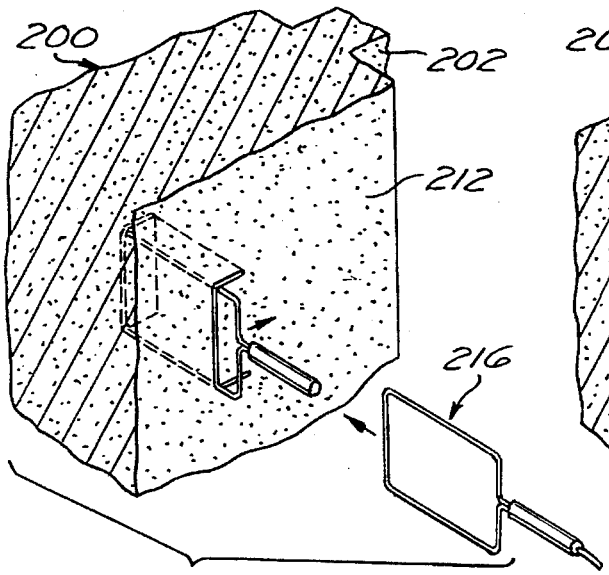
Fig. 22a
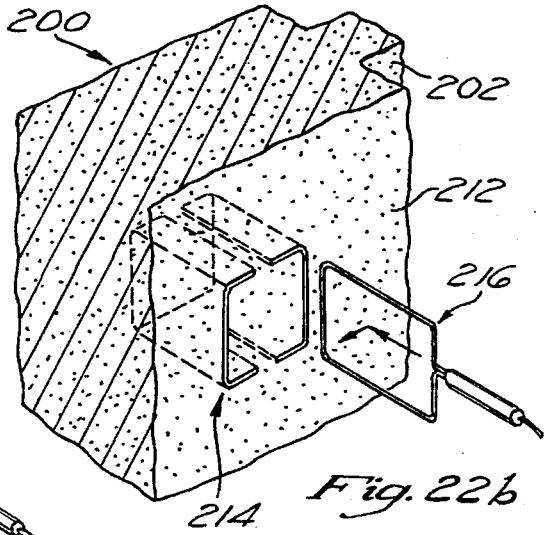
Fig. 22b
Fig. 23
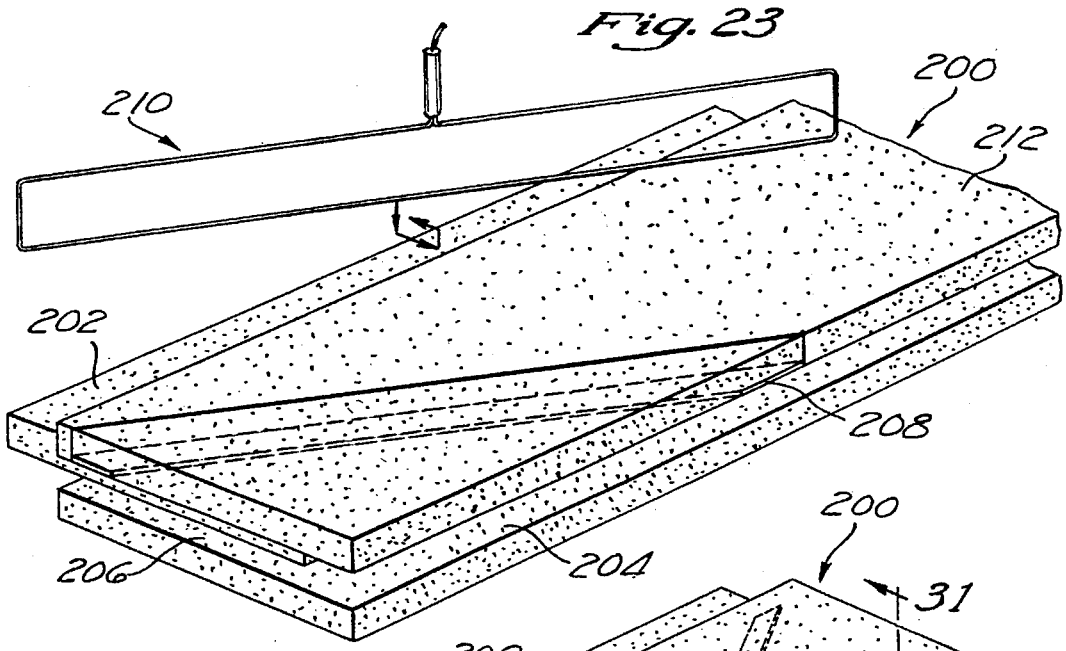
Fig. 24
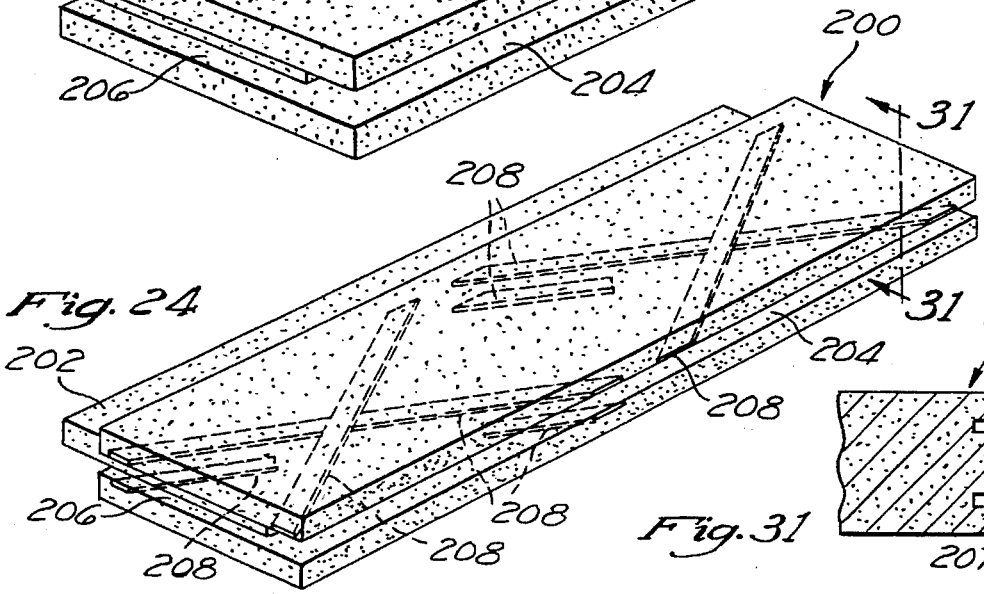
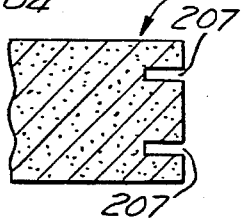
Fig. 31

Fig. 25
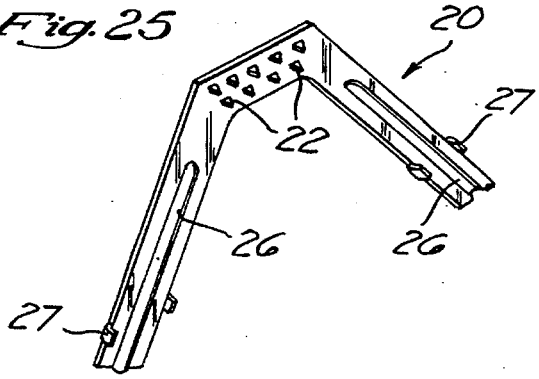
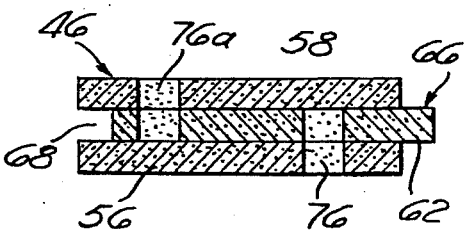
Fig. 26
Fig. 27
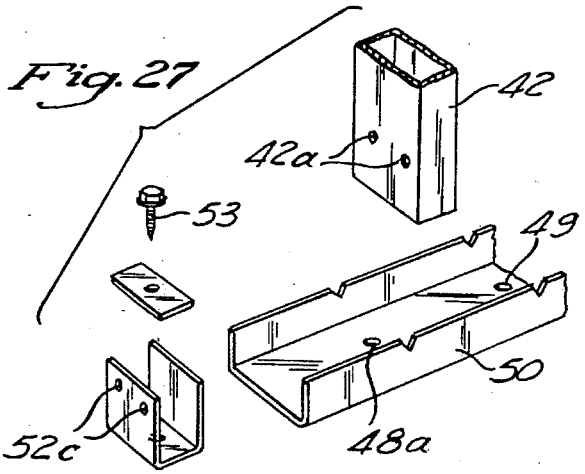
Fig. 28
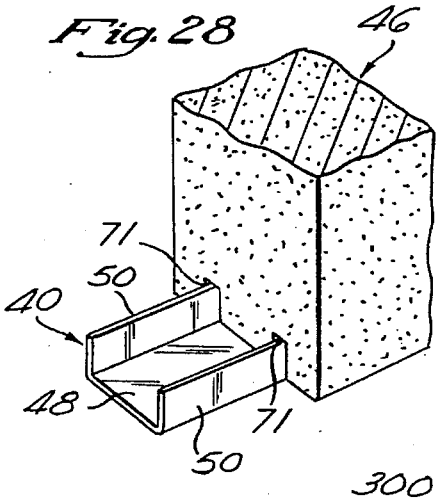
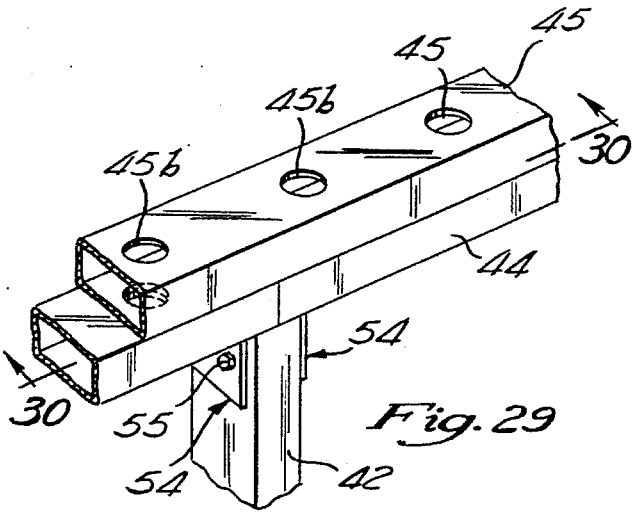
Fig. 29
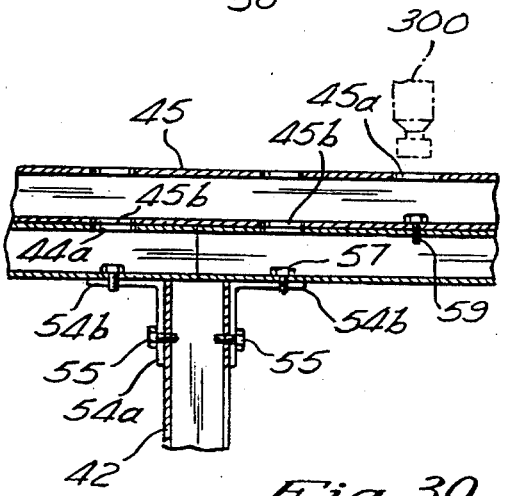
Fig. 30

BUILDING STRUCTURE AND METHOD OF USE

FIELD OF THE INVENTION

The present application is a continuation-in-part of application Ser. No. 07/897,909 filed Jun. 12, 1992, resulting in U.S. Pat. No. 5,353,560, issued Oct. 11, 1994, and entitled IMPROVED BUILDING STRUCTURE AND METHOD OF USE, the entire disclosure of which is expressly incorporated herein by reference. The present invention relates generally to residential and commercial building structures and methods of forming the same, and more particularly to integrated wall, floor and ceiling structures formed of dimensionally stable, pre-manufactured structural elements which are rapidly assembled in a manner resulting in a monolithic building structure.

BACKGROUND OF THE INVENTION

As is well known in the construction industry, builders of both residential and commercial building structures often face numerous difficulties during the construction process when utilizing forest products due to the lack of dimensional stability inherent with such products. In this respect, builders and craftsmen typically labor with the wood in an attempt to shape and fit the wooden components. However, oftentimes the wood members twist, warp, split or crack during and subsequent to completion of the building project, thus impairing the quality and appearance of the building structure.

In relation to consumer products, modern material fabrication and assembly techniques have permitted manufacturers to hold close tolerances and have allowed for the development of mass production methods which have made it possible for consumers to enjoy a wide variety of products at affordable prices. However, such mass production methods have not successfully found their way into the construction industry on any significant scale. In this respect, billions of dollars have been spent by the construction industry in an attempt to adopt mass production methods to produce housing at more affordable prices. However, such efforts have generally fallen short due to the previously described dimensional instability of the wooden components typically utilized in construction, as well as the requirement of utilizing skilled labor to build the structures.

In recent years, some advancements have been introduced to wood construction through the use of reconstituted wood-based products with enhanced strength and dimensional stability. Other advancements in construction techniques have included the gradual conversion to steel, aluminum, plastic and other more stable building materials. Additionally, a number of attempts have been made to develop building wall structures which integrate framing and wall panels to form a composite wall. Certain ones of these prior art wall structures comprise an assembly of wall panels or wall bricks having hollow passages which form a series of interlocking vertical and horizontal passages in the assembly. These passages are filled with concrete, with or without rebar, to form structural framing, integral with the wall panel or bricks. Other types of prior art structures comprise reinforced composite wall panels that are interlocked to form a wall structure. A third type of prior art structure comprises an assembly of foam plastic forms that function as permanent concrete forms after the concrete has been poured between the forms.

Though many of the aforementioned prior art building materials and systems present improvements over the more traditional prior art materials and building systems, these materials and building systems possess certain inherent deficiencies which detract from their overall utility. In particular, the aforementioned prior art wall structures, although reputed as being easy to assemble, often require substantial planning and piecemeal methods for forming windows and doors. Additionally, these prior art wall structures typically require a substantial amount of concrete which, though being widely available in some form, is not always of sufficient structural, load-bearing capability. Additionally, the aforementioned materials and building methods are often deficient with regard to critical factors such as cost, material availability, capital requirements for manufacturing and transportation, technical skills both in the factory and field, and ease of construction.

In recognition of the deficiencies of the prior art building materials and building systems, Applicant developed the improved building structure as disclosed in U.S. Pat. No. 5,353,560. In particular, Applicant developed integrated wall, floor and ceiling structures that employ no concrete and are fabricated from a minimum number of dimensionally stable, standardized framing elements and standard panels to form a resultant monolithic building structure. This building structure may be assembled with a minimum number of tools and does not require the employment of skilled labor, such as carpenters, bricklayers and concrete pourers.

Though the wall, floor and ceiling structures as disclosed in U.S. Pat. No. 5,353,560 present advantages over the prior art, such structures themselves possess certain deficiencies. Such deficiencies include the lack of auxiliary bracing in the wall structure for providing enhanced structural integrity thereto, and the difficulty in forming air plenums in the floor and ceiling structures which facilitate air flow in multiple directions. Other deficiencies include the cost associated with the fabrication of the standard panels, and the susceptibility of such panels to buckling in compression and tension when the wall structure is subjected to a shear force. One further deficiency is related to the time and difficulty associated in forming recesses within the standard panels to accommodate electrical components such as switch boxes. The present invention specifically addresses these and other deficiencies of the prior art building systems, as well as the building system disclosed in U.S. Pat. No. 5,353,560.

SUMMARY OF THE INVENTION

In accordance with a preferred embodiment of the present invention, there is provided an improved building system including dimensionally stable wall, floor, roof and ceiling structures. In the preferred embodiment, the wall structure comprises a wall frame which itself comprises an elongate track or U-bracket having a generally U-shaped configuration and defining a bottom wall adapted to be extended along and attached to a building foundation and opposing side walls extending upwardly from the bottom wall. The track is preferably fabricated from sheet metal, with a layer of polymer sealing material being placed between the bottom wall of the track and the foundation to facilitate a moisture tight, thermal barrier.

The bottom ends of dimensionally stable, pre-apertured vertical posts or studs are attached to brackets which are disposed within the track at predetermined locations along the length thereof and attached to the foundation. As such, the track is used for the alignment and indexing of the brackets and hence the posts. The bottom ends of the posts are preferably positioned directly over the fasteners used to attach the track to the foundation so as to enhance the seismic stability of the resultant wall structure. In this respect, during seismic activity, the weight of the building is resisted by the interaction of the foundation to the wall structure wherein the holding power at the lever arms of the posts is maximized. Secured to the top ends of the posts is at least one elongate, horizontal header beam. In the preferred embodiment, the top end of each post is attached to the header beam via a pair of header brackets, each of which includes a vertical flange portion attached to the top end of the post and a horizontal flange portion attached to the header beam.

Disposed between each pair of adjacent posts is a pre-fabricated wall section. In the preferred embodiment, each of the wall sections comprises first and second layers defining outer surfaces and inner surfaces having a plurality of diagonally extending slots formed therein. Disposed between the first and second layers is a third or middle layer which itself defines opposed side surfaces. The inner surfaces of the first and second layers are adhesively secured to respective ones of the side surfaces of the middle layer, with channel segments being defined between the slots and the side surfaces. When the various layers are secured to each other, the middle layer of the wall section defines a vertical tongue extending along a first vertical edge portion thereof. Additionally, the first, second and middle layers define a generally U-shaped vertical slot which extends along a second vertical edge portion of the wall section. The first, second and middle layers further define a pair of parallel grooves extending along a lower edge portion of the wall section for receiving the opposing side walls of the track, and a horizontal slot extending along a horizontal edge portion of the wall section for receiving at least a portion of the header beam. The first, second and middle layers of each wall section are preferably fabricated from polystyrene foam. Each wall section may alternatively comprise a unitary foam block wherein the channel segments, vertical tongue, vertical slot, parallel grooves and horizontal slot are formed through the utilization of a hot wire. In the preferred embodiment, each of the wall sections is disposed between a pair of adjacent posts such that the vertical tongue abuts one of the posts of the post pair and the vertical slot receives and encapsulates the other post of the post pair and the vertical tongue of an adjoining wall section, with the post received into the vertical slot being abutted against the interior surface thereof. Advantageously, the encapsulation of the posts increases the energy efficiency of the resultant wall structure by preventing the posts from acting as heat sinks.

Attached to the wall frame are at least two pairs of brace members which extend diagonally between the track and the header beam, and through at least two adjacent wall sections, in a generally X-shaped configuration. In particular, the brace members of each pair are extended diagonally between first and third vertical posts which are separated by a second or central vertical post. The upper ends of the brace members of each pair are rigidly attached to the header beam adjacent the top ends of the first and third posts, with the lower ends being rigidly attached to the first and third posts adjacent the bottom ends thereof and the overlapped middle portions being rigidly attached to the central vertical post. In accordance with a second embodiment of the present invention, the brace members of each pair comprise upper and lower brace segments, each of which define first and second ends. When the brace members are configured in this manner, the first ends of the upper brace segments of each pair are rigidly attached to the header beam adjacent the top ends of the first and third posts, with the first ends of the lower brace segments of each pair being rigidly attached to the first and third posts adjacent the bottom ends thereof. The second ends of the upper and lower brace segments of each pair are pivotally connected to the central vertical post. The brace members constructed in accordance with either embodiment are slidably received into elongate channels which extend through adjacent wall sections in an X-shaped configuration and are defined by the alignment of respective ones of the diagonally extending channel segments formed within each of the wall sections. The wall structure may include a multiplicity of brace member pairs attached to the wall frame in spaced relation. The interface between the wall frame, wall sections and brace members produces a synergistic effect by utilizing the compressive, tensile and shear force properties of the wall frame and wall sections, thus forming a monolithic wall structure.

In the preferred embodiment, the first and middle layers of each of the wall sections include at least one electrical component knock-out formed therein, with the first and second layers each including at least one center knock-out formed therein for accessing the overlapped portions of the brace members of each pair. In addition to the center knock-outs, the first and second layers each include a lower knock-out for accessing the lower ends of the brace members or first ends of the lower brace segments to facilitate the attachment thereof to the first and third posts. When the wall section is fabricated from the unitary foam block, the various knock-outs are formed therein through the utilization of a hot knife. The vertical posts and the header beam are preferably fabricated from tubular steel, with the brace members also preferably being fabricated from steel.

The floor structure of the present invention preferably comprises a plurality of elongate floor joists which are attached to the foundation and extend in parallel relation. Each of the floor joists preferably comprises elongate upper and lower cords defining opposed longitudinal edges and a pair of angled truss members rigidly attached to and extending between corresponding ones of the longitudinal edges in a manner orienting the upper and lower cords in spaced, parallel relation. Disposed between the upper and lower cords and the truss members is an insert member which is preferably fabricated from polystyrene foam or other suitable, substantially rigid insulating materials. Each of the truss members includes a plurality of elongate, arcuately contoured extensions formed therein and hook portions formed along the edges thereof which are adapted to engage and capture the insert member between the truss members in a manner preventing any movement thereof between the upper and lower beams and the truss members. The upper and lower cords are preferably fabricated from wood, metal or other suitable materials, with the truss members being fabricated from steel. Disposed between each pair of adjacent floor joists is a pre-fabricated, polystyrene foam floor section. Each of the floor sections includes first and second horizontal edge portions which are abutted against and adhesively secured to a truss member of each joist of the floor joist pair.

The monolithic ceiling and roof structures of the present invention are identically configured and each preferably comprise a plurality of elongate roof/ceiling trusses which are attached to the header beam and extend in parallel relation. The header beam is preferably pre-drilled to facilitate the proper alignment of the roof/ceiling trusses. The ceiling and roof trusses preferably are identical to and fabricated in the same manner as the floor joists. Disposed between each pair of adjacent roof/ceiling trusses is a pre-fabricated, polystyrene foam roof/ceiling section which includes first and second opposed, longitudinally extending edge portions. Each roof/ceiling section is disposed between a pair of adjacent roof/ceiling trusses in a manner wherein the edge portions thereof are abutted against and adhesively secured to a truss member of each of the roof/ceiling trusses of the roof/ceiling truss pair.

The present invention further comprises a method of forming a monolithic wall structure from a wall frame, interlocking foam wall sections, and at least one pair of brace members. The method comprises the step of attaching an elongate track or U-bracket to a horizontal foundation and subsequently attaching the bottom end of a first post to the foundation via a first pre-fabricated registration means disposed at a predetermined location within the track. A pre-fabricated wall section is then disposed upon the track in a manner wherein a vertical slot formed therewithin encapsulates the first post, with the first post being abutted against the interior surface of the vertical slot. The bottom end of a second post is then secured to the foundation at a predetermined location within the track in a manner wherein the second post is abutted against a vertical tongue defined by the first wall section. Thereafter, a second wall section is disposed upon the track in a manner wherein a vertical slot formed therewithin receives and encapsulates the second post and the vertical tongue of the first wall section, with the second post being abutted against the interior surface of the vertical slot formed within the second wall section. The bottom end of a third post is then secured to the foundation at a predetermined location within the track in a manner wherein the third post is abutted against a vertical tongue defined by the second wall section. A lower horizontal header beam is then secured to the top ends of the posts via a second pre-fabricated registration means. Thereafter, a pair of elongate brace members are inserted into complimentary channels disposed within the first and second wall sections which extend between the header beam and the track in a generally X-shaped configuration. Finally, the brace members are themselves attached to the wall frame.

In the preferred method, the first post is plumbed with the second and third posts being subsequently plumbed due to the dimensional stability of the first and second registration means. Sill and jam members may be attached to and extended horizontally between pairs of adjacent posts for purposes of constructing windows or doors. In those instances when a window or door is constructed, the wall sections of the wall structure must be cut to accommodate the same. The method may also include the step of placing a plumbing manifold and electrical system into the wall sections without cutting through the posts, the header beam and/or the brace members.

The present invention further comprises methods of forming monolithic floor, roof and ceiling structures. The formation of the floor structure comprises the steps of attaching an elongate floor joist to the foundation and subsequently abutting and rigidly securing a first horizontal edge portion of a floor section thereagainst. A second floor joist is then attached to the foundation in a manner wherein the second joist is abutted against and rigidly secured to a second horizontal edge portion of the floor section. Each of the floor joists is preferably formed by attaching a pair of truss members to corresponding ones of the longitudinal edges of upper and lower beams such that the upper and lower beams extend in spaced, parallel relation, and subsequently placing an insert member between the upper and lower beams and the truss members. The method of fabricating the floor structure further comprises the step of applying a layer of finishing material such as plywood over the tops of the floor joists.

The method of forming the ceiling and roof structures comprises the steps of attaching a roof/ceiling truss to the header beam and subsequently rigidly securing a first longitudinally extending edge portion of a roof/ceiling section thereto. A second roof/ceiling truss is then attached to the header beam in a manner wherein the second truss is abutted against a second longitudinally extending edge portion of the roof/ceiling section and rigidly secured thereto. The ceiling and roof trusses are configured identically to, and formed in the same manner as the floor joists. The method of forming the roof structure may further include the step of inserting a solar water heating system into air plenums defined between the top surfaces of the roof sections and a layer of sheathing applied to the roof trusses.

It is an object of the present invention to provide a wall structure incorporating interchangeable wall sections and brace members which, in combination, enhance the shear strength of the wall structure and its ability to withstand wind force.

Another object of the present invention is to provide wall, floor and roof/ceiling structures which are adapted to maximize energy efficiency while providing optimal living comfort.

Another object of the present invention is to provide a wall structure incorporating vertical posts which are encapsulated by wall sections so as to optimize the insulation qualities of the wall structure.

Another object of the present invention is to provide a floor structure which is adapted to create moisture and radon gas barriers, as well as optimal insulation.

A further object of the present invention is to provide a residential structure incorporating wall, floor and roof/ceiling structures which are adapted to maximize air tightness so that the living environment can be maintained in an energy-efficient manner.

BRIEF DESCRIPTION OF THE DRAWINGS

These, as well as other features of the present invention will become more apparent upon reference to the drawings wherein:

FIG. 1 is a perspective view of a residential dwelling constructed utilizing the building structures of the present invention;

FIG. 2 is a perspective view of a floor joist and ceiling truss of the present invention including air plenums formed therein;

FIG. 3 is a cutaway perspective view of the floor structure of the present invention;

FIG. 4 is a cross-sectional view taken along line 4—4 of FIG. 2;

FIG. 14 is a cutaway perspective view of a wall structure constructed in accordance with a second embodiment of the present invention;

FIG. 15 is a perspective view of a brace member segment incorporated into the wall structure shown in FIG. 14;

FIGS. 16 and 17 are side elevational views illustrating the engagement of the brace member segments to a central post of the wall structure shown in FIG. 14;

FIGS. 23*a* and 22*b* are partial perspective views illustrating the manner in which a knock-out is formed within a unitary wall section constructed in accordance with a second embodiment of the present invention;

FIG. 23 is a perspective view illustrating the manner in which channel segments are formed in the unitary wall section constructed in accordance with the second embodiment of the present invention;

FIG. 24 is a perspective view of the unitary wall section constructed in accordance with the second embodiment of the present invention;

FIG. 25 is a partial perspective view of a truss member used in conjunction with the floor, ceiling and roof structures of the present invention;

FIG. 26 is a cross-sectional view taken along line 26—26 of FIG. 11;

FIG. 27 is an exploded view illustrating the components used to secure the posts of the wall structure to the foundation;

FIG. 28 is a partial perspective view illustrating the manner in which the wall sections and track of the wall structure are interfaced to each other;

FIG. 29 is a partial perspective view illustrating the manner in which the upper header beam, lower header beam and posts of the wall structure are interfaced to each other;

FIG. 30 is a cross-sectional view taken along line 30—30 of FIG. 29; and FIG. 31 is a partial cross-sectional view taken along line 31—31 of FIG. 24.

DETAILED DESCRIPTION OF THE PREFERRED EMBODIMENTS

Figure 5:
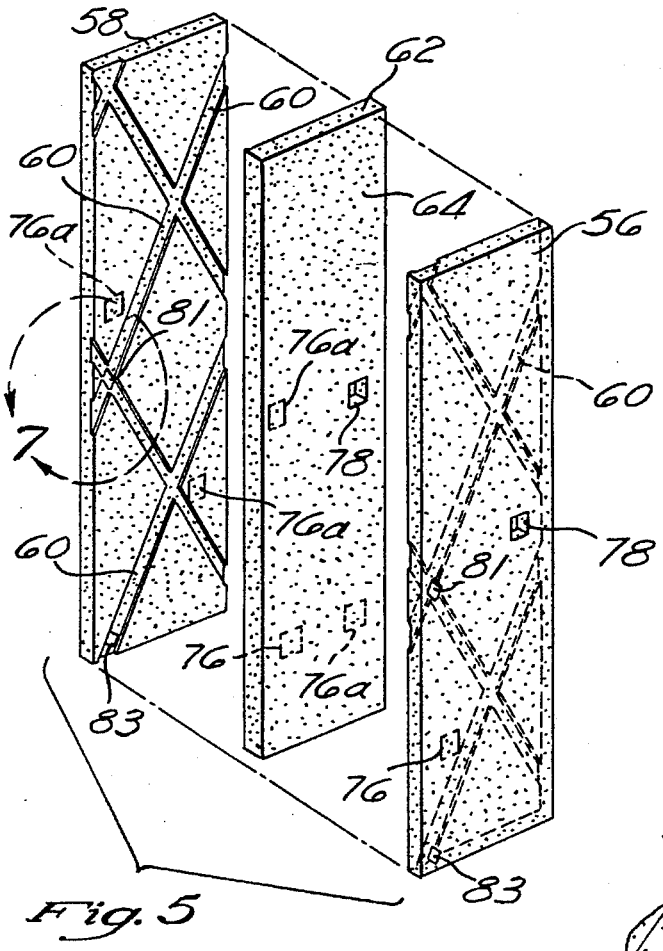
FIG. 5 is an exploded view of a wall section incorporated into the wall structure of the present invention.

Referring now to the drawings wherein the showings are for purposes of illustrating preferred embodiments of the present invention only, and not for purposes of limiting the same, FIG. 1 illustrates a residential structure 10 constructed utilizing the improved wall, floor and ceiling structures of the present invention. Although the present invention as will hereinafter be described has specific utility in relation to residential structures, it will be recognized that the various building structures and methods of fabricating the same may additionally be utilized in conjunction with commercial building structures. Additionally, though the wall, floor and ceiling structures of the present invention will be described as being utilized to fabricate the residential structure 10 having the design depicted, it will be recognized that such components are of sufficient architectural flexibility so as to be usable in conjunction with residential or commercial structures having a wide variety of different design configurations.

The wall, floor and ceiling structures of the present invention are fabricated from dimensionally stable components which allow the structures, and hence the residential structure 10, to be assembled by unskilled labor with a minimal amount of difficulty. Additionally, each of the components utilized to fabricate the wall, floor and ceiling structures are pre-fabricated off-site using high tolerance mass production techniques. The present building structures and building techniques are adapted to fabricate the residential structure 10 from the foundation to the roof by providing the necessary wall, floor and ceiling structural elements. In the following paragraphs, the wall, floor and ceiling structures of the present invention and methods of fabricating the same will be separately described.

FLOOR STRUCTURE

Referring now to FIGS. 2–4 and 25, the monolithic floor structure 12 comprises a plurality of floor joists 14 which are attached to the foundation of the residential structure 10 so as to extend in spaced, parallel relation, as seen in FIG. 3. The foundation to which the joists 14 are connected comprises a concrete foundation which is fabricated in accordance with conventional foundation construction techniques. The attachment of the floor joists 14 to the foundation is facilitated in the same manner as described in application Ser. No. 07/897,909.

Each of the floor joists 14 preferably comprises an elongate upper cord 16 and an elongate lower cord 18, each of which define opposed longitudinal edges. Rigidly attached to and extending between corresponding ones of the longitudinal edges in side-by-side relation are a plurality of angled webs or truss members 20 which orient the upper and lower cords 16, 18 in spaced, parallel relation. The upper and lower cords 16, 18 are preferably fabricated from wood, metal or other suitable materials, with the truss members being fabricated from steel. The attachment of the truss members 20 to the upper and lower cords 16, 18 is preferably facilitated through the utilization of barbs 22 integrally formed on the center and opposed end portions of each truss member 20, though other attachment methods may also be utilized. As will be recognized, the truss members 20 including the barbs 22 formed thereon are used only in relation to upper and lower cords 16, 18 which are fabricated from wood. In the event the upper and lower cords 16, 18 are fabricated from metal, the truss members 20 used in association therewith will be devoid of the barbs 22, and attached to the upper and lower cords 16, 18 via spot welds or other suitable fasteners.

Disposed between the upper and lower cords 16, 18 and truss members 20 is an elongate, rectangularly configured insert member 24. The insert member 24, when positioned between the upper and lower cords 16, 18 and truss members 20, is abutted against the inner surfaces of the truss members 20 and spaced equidistantly from the inner surfaces of the upper and lower cords 16, 18. The preferred spacing between the top and bottom surfaces of the insert member 24 and inner surfaces of the upper and lower cords 16, 18 is three and one-half inches. In the preferred embodiment, each of the truss members 20 includes a plurality of elongate, arcuately contoured extensions 26 formed within the diagonally extending portions thereof. Additionally, preferably formed along the edges of each diagonally extending portion are at least three (3) opposed pairs of fingers or hook portions 27. The extensions 26 and hooked portions 27 are adapted to be extended into and engage the insert member 24 in the manner shown in FIG. 4 to capture the insert member 24 between the truss members 20 and prevent any movement thereof between the upper and lower cords 16, 18 and truss members 20. However, the truss members 20 need not be provided with the hooked portions 27 since the engagement of the extensions 26 to the insert member 24 is typically sufficient to prevent any movement of the insert member 24 between the upper and lower cords 16, 18 and truss members 20. Advantageously, the assembly of the floor joists 14 to include the truss members 20 provides the floor joists 14 with strength as well as vertical and lateral load resistance. Each of the floor joists is preferably formed by placing the insert member 24 equidistantly between the upper and lower cords 16, 18, and thereafter attaching the truss members 20 to corresponding ones of the longitudinal edges of the upper and lower cords 16, 18, thus capturing the insert member 24 therebetween in the previously described manner. The insert member 24 is preferably fabricated from polystyrene foam or other suitable, substantially rigid insulating materials.

Disposed between each pair of adjacent joists 14 is a pre-fabricated floor section 28. In the preferred embodiment, each floor section 28 incorporated into the floor structure 12 is also preferably fabricated from polystyrene foam and defines opposed first and second horizontal edge portions. Each of the floor sections 28 is disposed between an adjacent pair of floor joists 14 in a manner wherein the first and second horizontal edge portions thereof are abutted against and adhesively secured to the outer surface of a truss member 20 of each of the adjacent floor joists 14. In the preferred embodiment, the arcuately contoured extensions 26 serve as reservoirs for the adhesive used to secure the first and second horizontal edge portions of a floor section 28 to the truss members 20 of an adjacent pair of floor joists 14. The adhesive, in addition to being placed into the extensions 26, is also spread over the opposed side surfaces of the insert members 24 of the floor joists 14 which also come into direct contact with the first and second horizontal edge portions of the floor sections 28. Importantly, the angled geometry of the trust members 20, and hence the extensions 26 formed therein, aids in maintaining each floor section 28 between an adjacent pair of floor joists 14. In addition to maintaining each floor section 28 between an adjacent pair of floor joists 14, the adhesive forms a seal for radon gas between the floor sections 28 and floor joists 14 in compliance with new Federal standards relating to radon gas penetration into residential structures. As seen in FIG. 3, the height of each of the floor sections 28 is approximately equal to the height of the insert members 24 of the floor joists 14, with the floor sections 28 being positioned between adjacent pairs of floor joists 14 such that the top and bottom surfaces thereof are continuous with the top and bottom surfaces of the insert members 24.

In assembling the floor structure 12, a first floor joist 14 is attached to the foundation of the residential structure 10. A quantity of adhesive material is then placed into the extensions 26 of a truss member 20 and over the corresponding side surface of the insert member 24. Thereafter, the first horizontal edge portion of a first floor section 28 is abutted against the truss member 20 of the first floor joist 14 to which the adhesive is applied. A second floor joist 14 having a quantity of adhesive material disposed in the extensions 26 of a truss member 20 and applied to the corresponding side surface of the insert member 24 is then attached to the foundation in parallel relation to the first floor joist 14, and in a manner wherein the second horizontal edge portion of the first floor section 28 is abutted against the truss member 20 and insert member 24 of the second floor joist 14 having the adhesive applied thereto, thus capturing and maintaining the first floor section 28 between the first and second floor joists 14. Additional floor joists 14 and floor sections 28 are subsequently assembled in an analogous manner throughout the floor structure 12. Advantageously, the abutment of the first and second horizontal edge portions of each floor section 28 against the truss members 20 of an adjacent pair of floor joists 14 produces a synergistic effect by utilizing the compressive, tensile and shear force properties of the joists 14 and floor sections 28, thus forming a monolithic floor structure 12.

After the floor joists 14 and floor sections 28 have been interfaced to each other in the aforementioned manner, a layer of finishing material such as a plywood sheet 30 is attached to the top surfaces of the upper beams 16. As will be recognized, since the insert member 24 is captured and maintained (i.e., suspended) between the upper and lower cords 16, 18 and the top surfaces of the floor sections 28 are continuous with the top surfaces of the insert members 24, the attachment of the plywood sheet 30 to the top surfaces of the upper beams 16 facilitates the formation of longitudinally and laterally extending spaces 32 between the plywood sheet 30 and the top surfaces of the floor sections 28 and insert members 24. The spaces 32 define longitudinally and laterally extending pathways or air plenums within the floor structure 12. In addition to defining air plenums, the spaces 32 may be used to provide dead-space insulation which, in conjunction with the polystyrene foam floor sections 28 and insert members 24, greatly enhances the overall thermal efficiency of the floor structure 12. Additionally, the spaces 32 may serve as ducting or electrical/plumbing service conduits as will be described in more detail below.

Though the floor structure 12 has been described for use in conjunction with a plywood sheet 30 serving as the layer of finishing material, it will be recognized that the design of the floor structure 12 may be modified to accommodate a concrete slab floor as would be used in a commercial building structure. Advantageously, the floor structure 12 of the present invention is designed so as to possess significant seismic stability when seismic forces are applied to the residential structure 10. Additionally, since the floor structure 12 does not incorporate cement or any other hydrophilic material, continual watering as would occur from automatic sprinklers around the base of the residential structure 10 is not easily absorbed into the floor structure 12 and thus not transported to the wood components thereof. As such, problems associated with mildew, dry rot, fungus and ground settling which are typically encountered with conventional floor structures are eliminated by the design and materials used in conjunction with the floor structure 12. Thus, the floor structure 12 is particularly adapted to be less susceptible to risk of damage when seismic forces are applied thereto. Further, when the floor structure 12 is assembled in the aforementioned manner, the foam floor sections 28 and insert members 24 of the floor joists 14 create a non-violative moisture barrier which prevents mold, bacteria, etc. from entering the residential structure 10. The previously described floor sections 28 are also used in conjunction with "on-grade" (i.e., slab) construction techniques. In this respect, the first and second horizontal edge portions of each floor section 28 are abutted against and adhesively secured to a truss member 20 of each one of an adjacent pair of floor joists 14 in the manner previously described so as to create a sealing effect for providing a moisture and radon gas barrier, as well as insulation.

WALL STRUCTURE

Referring now to FIGS. 5–12, the present invention further comprises a dimensionally stable, monolithic wall structure 36 which, like the floor structure 12, is specifically adapted to resist shear and to be seismically stable. As best seen in FIGS. 11, 12, 14 and 27, the wall structure 36 comprises a wall frame 38 which itself is formed from an elongate U-bracket or track 40, plural studs or posts 42, lower header beam segments 44, an upper header beam 45, and plural wall sections 46 which are assembled upon the floor. The posts 42, header beam segments 44 and header beam 45 are preferably fabricated from tubular steel and are pre-fabricated off-site. The posts 42, header beam segments 44 and header beam 45 may alternately be fabricated from dimensionally stable LVL (laminated veneer lumber) material. The track 40 is preferably formed from sheet metal having a generally U-shaped configuration defining a bottom wall 48 and opposing side walls 50 which extend upwardly from the bottom wall 48. The track 40, and in particular the bottom wall 48 thereof, is adapted to be extended along the plywood sheet 30 or other finishing material of the floor structure 12 and attached thereto via a plurality of fasteners such as self-tapping screws. The fasteners are extended through the bottom wall 48 via a plurality of preformed, linearly aligned bottom wall apertures 49 disposed therein at predetermined locations along the length of the track 40. Additionally, a separate polymer plate or similar structure is preferably inserted between the bottom wall 48 and top surface of the plywood sheet 30 so as to form a moisture-tight, thermal barrier.

The elongate, vertical posts 42 of the wall structure 36 are preferably formed of pre-determined lengths, and include bottom ends which are secured to generally U-shaped brackets 52 disposed within the track 40 (i.e., between the side walls 50) at predetermined locations along the length thereof. The preferred spacing between the brackets 52 and hence the posts 42 is twenty-four inches. Each bracket 52 is rigidly attached to the foundation by the extension of a fastener 53 through an aperture **52*a* disposed in the horizontal bottom wall portion 52*b* thereof and into the foundation via an aperture 48*a* disposed in the bottom wall 48 of the track 40. Advantageously, the side walls 50 of the track 40 include V-shaped indexing notches 51 disposed therein in opposed pairs for maintaining a drill in vertical registry with the aperture 48*a* for purposes of drilling a hole into the foundation to receive the fastener 53. Each fastener 53 preferably includes a rectangularly configured fastener plate 53*a* associated therewith which is compressed between the bottom wall 48 and the head of the fastener 53 when the bracket 52 is attached to the foundation thereby. As such, the track 40 is used for the alignment and indexing of the brackets 52 and the posts 42. Each of the brackets 52 preferably includes pre-formed apertures 52*c* disposed within one of the vertical sidewall portions 52*d* thereof which are oriented so as to be in registry with corresponding apertures 42*a* pre-formed in the bottom ends of the posts 42**.

The posts 42 are secured to the brackets 52 by inserting the bottom ends thereof between the vertical sidewall portions **52*d* of the brackets 52 in a manner wherein the apertures 42*a*, 52*c* disposed in the posts 42 and brackets 52 are coaxially aligned. Thereafter, fasteners such as self-tapping screws are extended through the coaxially aligned apertures 42*a*, 52*c*, thus securing the posts 42 to the brackets 52. Since the brackets 52, and hence the posts 42, are secured directly to the foundation, the seismic stability of the wall structure 36 is significantly increased. Though not shown, the track 40 may be formed in a manner wherein the brackets 52 are integral portions thereof. The track 40 formed in this manner is provided with a plurality of pre-formed apertures disposed within the bottom wall 48** thereof for allowing fasteners to be extended directly into the foundation.

The top ends of selected ones of the fasteners 53 utilized to secure the brackets 52 to the foundation may be disposed directly under the posts 42. Each of the posts 42 preferably includes a fastener 53 directly underneath the bottom end thereof. As such, to accommodate the top ends of fasteners 53, the bottom end of each of the posts 42 is provided with a recess or counterbore disposed therein. Importantly, the fastener plate **53*a* associated with each fastener 53 is sized so as to be slightly smaller than and therefore receivable into the recess or counterbore disposed within the bottom end of each of the posts 42. In this respect, the receipt of the fastener plate 53*a* into the bottom end of the post 42 facilitates the registry of the post 42 between the vertical side wall portions 52*d* of the bracket 52 in a manner wherein the apertures 42*a* of the post 42 are coaxially aligned with the apertures 52*c* of the bracket 52. Advantageously, the placement of the fasteners 53 into the foundation directly under the posts 42 also aids in increasing the seismic stability of the wall structure 36. During seismic activity, the weight of the residential structure 10 is resisted by the interaction between the foundation and the wall structure 36 attributable to the extension of the fasteners 53 directly into the foundation. In this respect, due to the brackets 52, and hence the posts 42, being rigidly attached to the foundation, the holding power is maximized at the lever arms of the posts 42. Though each of the posts 42 preferably includes a fastener 53 located underneath the bottom end thereof, the fasteners 53 may be included only under selected ones of the posts 42**.

Referring now to FIGS. 29 and 30, in the wall frame 38, attached to the top ends of the posts 42 are a plurality of the horizontally oriented lower header beam segments 44 which extend in end-to-end fashion. In the preferred embodiment, the attachment of the lower header beam segments 44 to the top ends of the posts 42 is facilitated by a plurality of header brackets 54. In this respect, each lower header beam segment 44 is extended between an adjacent pair of the posts 42, and attached to one of the two header brackets 54 attached to the top end of each of the posts of the adjacent pair 42. Each of the header brackets 54 has a generally L-shaped configuration and includes a vertical flange portion **54*a*** having preformed vertical flange apertures disposed therein which are oriented so as to be in registry with pre-formed apertures disposed adjacent the top ends of the posts 42. As previously indicated, a pair of header brackets 54 is preferably attached to the top end of each post 42 by abutting the vertical flange portions 54*a* thereof against the top end such that the vertical flange apertures disposed in the vertical flange portions 54*a* are coaxially aligned with the apertures disposed adjacent the top end of the post 42. Thereafter, fasteners such as self-tapping screws 55 are extended through the coaxially aligned apertures, thus securing the header brackets 54 to the post 42.

In addition to the vertical flange portion 54*a*, each of the header brackets 54 includes a horizontal flange portion 54*b* having horizontal flange apertures disposed therein which are oriented so as to be in registry with corresponding pre-formed apertures 44*a* disposed within the top and bottom surfaces of the lower header beam segments 44 in coaxially aligned pairs. When a pair of header brackets 54 is attached to the top end of a post 42, the horizontal flange portions 54*b* thereof and the uppermost end of the post 42 define a generally planar surface against which portions of the bottom surfaces of a pair of the lower header beam segments 44 are rested. As best seen in FIG. 30, the apertures 44*a* disposed within the bottom surfaces of the lower header beam segments 44 are sized identically to the horizontal flange apertures. However, the apertures 44*a* disposed within the top surfaces of the lower headed beam segments 44 are significantly larger in diameter than those disposed in the bottom surfaces thereof. To avoid any buckling or collapse of the metal lower header beam segments 44 when the same are attached to the header brackets 54, the fasteners 57 used to facilitate such attachment are preferably extended only through the apertures 44*a* disposed within the bottom surfaces and the horizontal flange apertures which are coaxially aligned therewith. In this respect, subsequent to the positioning of the lower header beam segments 44 upon the horizontal flange portions 54*b* of the header brackets 54, the fasteners 57 (which are typically self-tapping screws) are extended through the apertures 44*a* disposed within the bottom surfaces and the horizontal flange apertures. Advantageously, the formation of the apertures 44*a* within the top surfaces with larger diameters allows a tool head 300 to be inserted into the hollow interior of the lower header beam segments 44 to facilitate the tightening of the fasteners 57, thus securing the lower header beam segments 44 to the header brackets 54. The header brackets 54 are preferably fabricated from metal, though other materials may be utilized as an alternative.

Subsequent to the attachment of the lower header beam segments 44 to the header brackets 54 in the aforementioned manner, rigidly attached to the top surfaces of the lower header beam segments 44 is an upper header beam 45. In the preferred embodiment, the upper header beam 45 includes pre-formed apertures 45*a* disposed in the top and bottom surfaces thereof in coaxially aligned pairs. The apertures 45*a* disposed within the top surface of the upper header beam 45 are sized identically to the apertures 44*a* disposed within the top surfaces of the lower header beam segments 44, with the apertures 45*a* disposed within the bottom surfaces of the upper header beam 45 being sized identically to the apertures 44*a* disposed within the bottom surfaces of the lower header beam segments 44. To avoid any buckling or collapse of the metal upper header beam 45 when the same is rigidly attached to the lower header beam segments 44, the fasteners 59 used to facilitate such attachment are preferably extended only through the apertures 45*a* disposed within the bottom surface of the upper header beam 45 and corresponding, equally sized apertures pre-formed in the top surfaces of the lower header beam segments 44 in coaxial alignment therewith. In this respect, subsequent to the positioning of the upper header beam 45 upon the top surfaces of the linearly extending lower header beam segments 44, the fasteners 59 are extended through the apertures 45*a* disposed within the bottom surfaces of the upper header beam 45 and the corresponding apertures disposed in the top surfaces of the lower header beam segments 44, with the fasteners 59 being tightened by the tool 300 which is insertable into the hollow interior of the upper header beam 45 via the larger diameter apertures 45*a* disposed within the top surface thereof.

In addition to the apertures 45*a*, the upper header beam 45 includes apertures 45*b* pre-formed therein. The apertures 45*b* are disposed in the top and bottom surfaces of the upper header beam 45 in coaxially aligned pairs which are oriented so as to be in registry with respective pairs of the coaxially aligned apertures 44*a* disposed within the top and bottom surfaces of the lower header beam segments 44. The diameters of the apertures 45*b* are preferably equal to the diameters of the apertures 44*a* disposed within the top surfaces of the lower header beam segments 44, thus creating a uniform passage directly to the apertures 44*a* disposed within the bottom surfaces of the lower header beam segments 44 and corresponding horizontal flange apertures. The passage formed by the aligned apertures 45*b*, 44*a* allows the tool 300 to be extended to the fasteners 57 used to rigidly attach the lower header beam segments 44 to the header brackets 54. Importantly, the inclusion of the apertures 45*b* in the upper header beam 45 allows the attachment of the lower header beam segments 44 to the header brackets 54 to be accomplished subsequent to the attachment of the upper header beam 45 to the lower header beam segments 44 in the aforementioned manner. However, as will be recognized, the attachment of the upper header beam 45 to the lower header beam segments 44 may still occur after the attachment of the lower header beam segments 44 to the header brackets 54.

Figure 6:
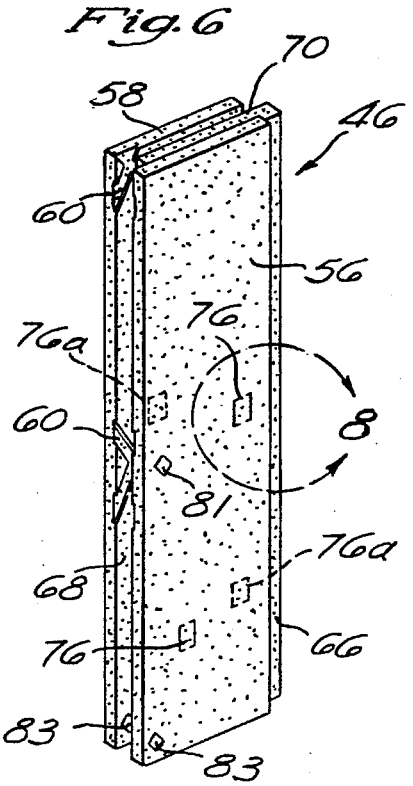
FIG. 6 is a perspective view of an assembled wall section.
Figure 8:
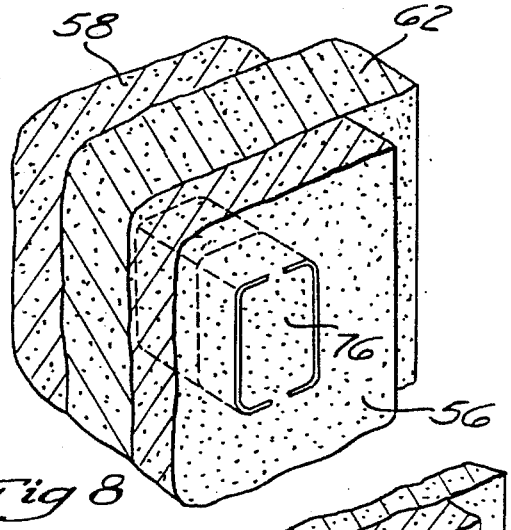
FIG. 8 is an enlargement of the encircled region of the wall section shown in FIG. 6, illustrating an electrical component knock-out formed within the wall section.
Figure 7:
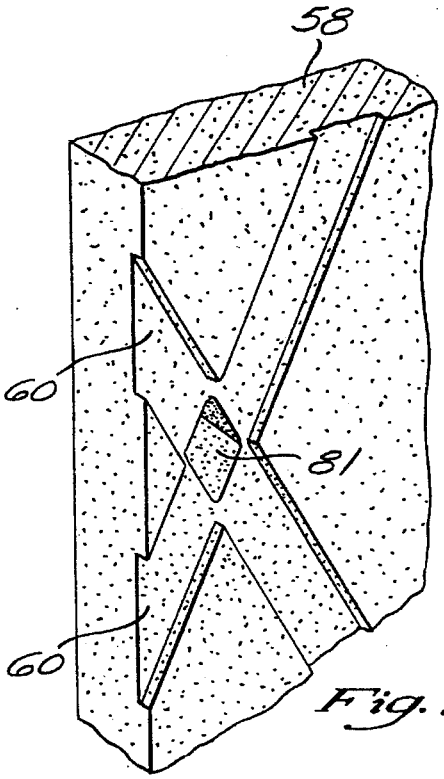
FIG. 7 is an enlargement of the encircled region of the wall section shown in FIG. 5, illustrating the channel segments and a center knock-out formed within the wall section.
Figure 9:
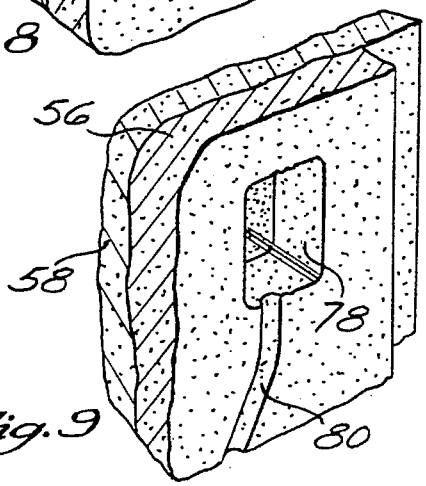
FIG. 9 is a partial perspective view illustrating the wall section with the electrical component knock-out removed therefrom and an electrical conduit formed therein.

Disposed between each pair of adjacent posts 42 is a pre-fabricated wall section 46. Referring now to FIGS. 5–7, each of the wall sections 46 is pre-fabricated off-site and comprises a first layer 56 and a second layer 58, each of which defines an outer surface and an inner surface having a plurality of diagonally extending slots 60 formed therein. Disposed between the first and second layers 56, 58 is a third or middle layer 62 defining a pair of opposed, generally planar side surfaces 64. In the preferred embodiment, the inner surfaces of the first and second layers 56, 58 are adhesively secured to respective ones of the side surfaces 64 of the middle layer 62 in the manner shown in FIG. 6. Due to the inclusion of the slots 60 in the inner surfaces of the first and second layers 56, 58, the attachment thereof to the middle layer 62 facilitates the formation of two sets of elongate, diagonally extending channel segments, with each set of channel segments being defined between the slots 60 in the inner surface of the first layer 56 or second layer 58 and a respective one of the side surfaces 64 of the middle layer 62. The use of the channel segments will be discussed in more detail below. In the preferred embodiment, the first, second and middle layers 56, 58, 62 are each rectangularly configured and fabricated from three inch thick polystyrene foam. As such, the wall section 46 formed by the attachment of the first and second layers 56, 58 to the middle layer 62 is likewise rectangularly configured with an overall thickness of approximately nine inches. The middle layer 62 is always fabricated with a three-inch thickness to match the width of the posts 42. The first and second layers 56, 58 are each fabricated with at least a one and one-half inch thickness, but may be made thicker depending on the desired R-value.

In the preferred embodiment, the first, second and middle layers 56, 58, 62 are attached to each other in a manner defining a vertical tongue 66 extending along a first vertical edge portion of the wall section 46 and a generally U-shaped vertical slot 68 extending along a second vertical edge portion of the wall section 46. Due to the manner in which the middle layer 62 is positioned between the first and second layers 56, 58, the vertical tongue 66 is defined by one of the two vertical edges of the middle layer 62, with the vertical slot 68 being defined by the other vertical edge of the middle layer 62 and portions of the inner surfaces of the first and second layers 56, 58. In addition to the vertical slot 68, the first, second and middle layers 56, 58, 62 define a horizontal slot 70 extending along a horizontal upper edge portion of the wall section 46. Similar to the vertical slot 68, the horizontal slot 70 is defined by the top edge of the middle layer 62 and portions of the inner surfaces of the first and second layers 56, 58. As seen in FIG. 28, the first, second and middle layers 56, 58, 62 further define a pair of parallel grooves 71 extending along a lower horizontal edge portion of the wall section 46 for receiving the opposing side walls 50 of the track 40. The horizontal slot 70 is sized to receive the lower header beam 44 in the manner shown in FIGS. 11, 12 and 14. In the wall structure 36, each wall section 46 is disposed between a pair of adjacent posts 42 such that the vertical tongue 66 abuts one of the posts 42 of the post pair and the vertical slot 68 receives and encapsulates the other post 42 of the post pair and the vertical tongue 66 of an adjoining wall section 46. As will hereinafter be discussed, each wall section 46 may alternatively be fabricated from a unitary foam section.

To assemble the wall structure 36, the entire track 40 is initially laid out upon the floor of the residential structure 10 to insure proper location. Thereafter, track fasteners are extended through respective apertures disposed within the bottom wall 48 to secure the track 40 to the floor. After the track 44 has been attached to the underlying support structure in the desired configuration for the residential structure 10, the brackets 52 are disposed within the track at desired locations therealong and attached to the foundation in the aforementioned manner. The bottom end of a first post 42 is then attached to a bracket 52 in the aforementioned manner. After a first post 42 has been attached to a bracket 52, a first wall section 46 is lowered upon the track 44 such that the opposing side walls 50 of the track 44 are received into the parallel grooves 71 formed in the lower horizontal edge portion of the wall section 46. Importantly, the wall section 46 is oriented such that the vertical slot 68 faces the first attached post 42. Thereafter, the wall section 46 is slid toward the first post 42 such that the post 42 is received into the vertical slot 68 and firmly abutted against the innermost surface thereof, i.e., a vertical edge of the middle layer 62. When the post 42 is received into the vertical slot 68, the horizontal flange portion of one of the header brackets of the pair already secured to the top end of the first post 42 will be received into the horizontal slot 70 and abutted against the lowermost surface thereof, i.e., the top edge of the middle layer 62.

After the first post 42 has been received into the vertical slot 68, the bottom end of a second post 42 is attached to a bracket 52 in a manner wherein the second post 42 is firmly abutted against the outermost surface of the vertical tongue 66, i.e., the vertical edge of the middle layer 62 opposite that defining the innermost surface of the vertical slot 68. The bracket 52 to which the bottom end of the second post 42 is attached is specifically oriented such that the second post 42 will abut the vertical tongue 66 in the aforementioned manner when attached thereto. After the second post 42 is attached to the bracket 52, the first wall section 46 will be firmly disposed, i.e., compressed, between the pair of adjacent posts 42.

A second wall section 46 is then placed upon the track 40 in the same manner previously described and oriented such that the vertical slot 68 thereof faces the vertical tongue 66 of the first installed wall section 46 and second installed post 42. The second wall section 46 is then slid toward the first wall section 46 to a position whereat both the second post 42 and vertical tongue 66 of the first wall section 46 are received into the vertical slot 68 of the second wall section 46. As such, the second post 42 is encapsulated by the first and second wall sections 46. Thereafter, the bottom end of a third post 42 is attached to a bracket 52 so as to abut the vertical tongue 66 of the second installed wall section 46 in the same manner previously described. As will be recognized, third and subsequent wall sections 46 used to form the wall structure 36 are added in the aforementioned manner. After the desired number of wall sections 46 have been assembled into the wall structure 36, the lower header beam segments 44, with or without the upper header beam 45 attached thereto, are placed into the linearly aligned horizontal slots 70 of the wall sections 46 and secured to the horizontal flange portions of the header brackets 54 in the aforementioned manner. The width and thickness dimensions of the lower header beam segments 44 are substantially identical to the width and depth dimensions of the horizontal slots 70. In the event the upper header beam 45 has not been previously attached to the lower header beam segments 44, subsequent to the placement of the lower header beam segments 44 into the aligned slots 70 and attachment thereof to the header brackets 54, the upper header beam 45 is extended along and rigidly attached to the lower header beam segments 44. Advantageously, the encapsulation of the posts 42 by adjacent wall sections 46 increases the energy efficiency of the wall structure 36 by preventing the metal posts 42 from acting as heat sinks. In this respect, in conventional building structures, the metal posts disposed within the walls act as thermal fins or radiators which conduct heat from within the structure to the outside. This particular deficiency is eliminated by the encapsulation of the metal posts 42 by the adjacent wall sections 46.

Figures 10, 11, 12, 13:
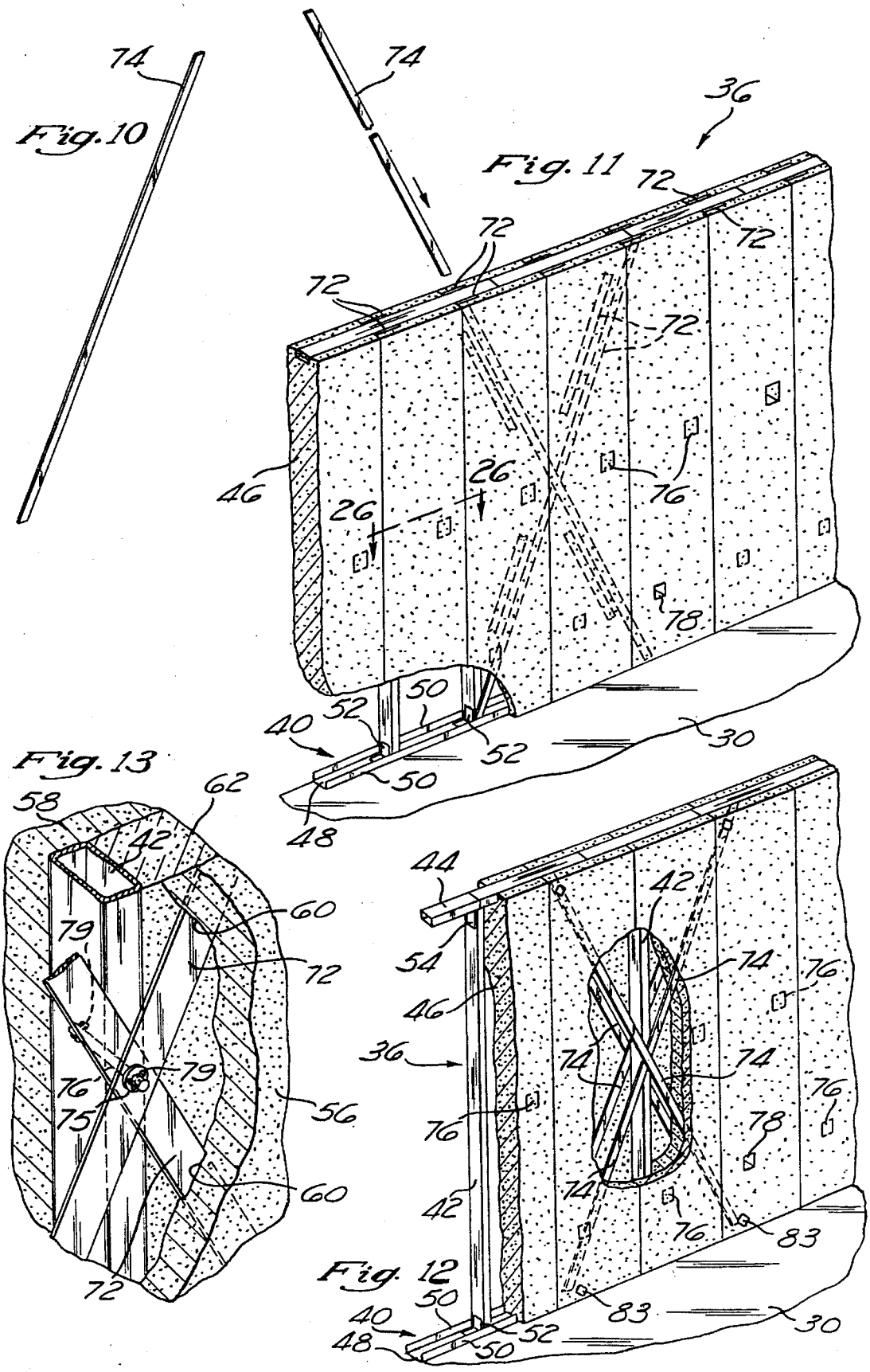
FIG. 10 is a perspective view of an elongate brace member constructed in accordance with a first embodiment of the present invention.
FIG. 11 is a cutaway perspective view illustrating the components comprising the wall structure of the present invention.
FIG. 12 is a cutaway perspective view of a fully assembled wall structure.
FIG. 13 is a cutaway perspective view illustrating the engagement of the brace members of the wall structure to a central post thereof.

Referring now to FIGS. 10–13, the engagement of the wall sections 46 to the posts 42, track 40, header beam segments 44 and header beam 45 facilitates the formation of opposed pairs of elongate channels 72 which extend diagonally through adjacent wall sections 46 between the track 40 and header beam segments 44. The channels 72 are formed by the placement of the channel segments defined within each wall section 46 into end-to-end alignment with corresponding ones of the channel segments defined within the adjacent wall sections 46, i.e., those wall sections interfaced to the first and second vertical edge portions of a central wall section. As will be recognized, to facilitate the formation of the channels 72, the slots 60 and thus the channel segments defined within each wall section 46 are specifically oriented so as to be brought into linear alignment with corresponding channel segments of an adjacent wall section 46 when the wall sections 46 are positioned within the wall frame 38 in the aforementioned manner. As best seen in FIG. 11, the channels 72 are typically formed by the alignment of certain ones of the channel segments of three (3) adjacent (i.e., consecutive) wall sections 46. In this respect, the channel segments are oriented in a manner wherein any three (3) successive wall sections 46 within the wall structure 36 define two pairs of channels 72, with each pair extending diagonally from the lower header beam segments 44 to the track 40 in a generally X-shaped configuration. One pair of the X-shaped channels 72 is defined between the first and the middle layers 56, 62 of the wall sections 46, with the other set of channels 72 being defined between the second and middle layers 58, 62 of the wall sections 46 in opposed relation to the first pair. Advantageously, due to the configuration of the two sets of channel segments defined within each wall section 46, any one wall section 46 within the wall structure 36 may be interchanged without disrupting the resultant formation of the opposed pairs of diagonally extending channels 72.

In the preferred embodiment, slidably inserted into each of the two opposed pairs of channels 72 defined within three successive wall sections 46 is a pair of elongate brace members 74 which are preferably fabricated from steel. When inserted into the channels 72 of each pair, the brace members 74 themselves assume a generally X-shaped configuration, with the middle portions thereof being overlapped. The depth of the slots 60 within the inner surfaces of the first and second layers 56, 58, and thus the width of each of the channels 72, is sized to accommodate at least four (4) different thicknesses of each brace member 74. When inserted into each pair of channels 72, the brace members 74, in addition to extending diagonally between the track 40 and lower header beam segments 44, extend diagonally between first and third posts 42 which are separated by a second or central post 42. The attachment of the brace members 74 of each pair to the wall frame 38 is preferably facilitated by rigidly attaching the upper ends to opposite sides of the lower header beam segments 44 adjacent the top ends of the first and third posts 42, and rigidly attaching the lower ends to opposite sides of the first and third posts 42 adjacent the bottom ends thereof. Additionally, the overlapped middle portions of the brace members 74 are rigidly attached to opposite sides of the central post 42.

Figure 18:
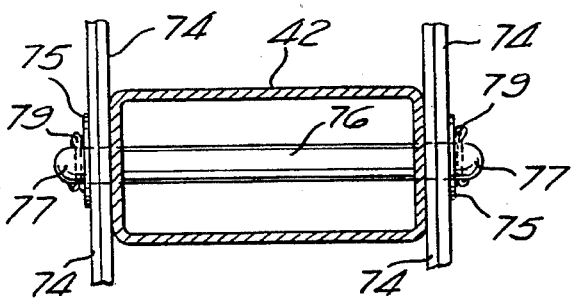
FIG. 18 is a cross-sectional view illustrating the manner in which the brace member and brace member segments are engaged to a central post of the wall structures shown in FIGS. 12 and 14.

Referring now to FIGS. 13 and 18, to facilitate the attachment of the overlapped middle portions of each pair of brace members 74 to the central post 42, extended longitudinally through the central post 42 is an elongate pin member 76, the opposed, rounded ends of which protrude outwardly from opposite sides of the central post 42. Extending laterally through the pin member 76 adjacent the rounded ends thereof is a pair of apertures 77. In the preferred embodiment, the middle portion of each brace member 74 includes an aperture disposed therein which is sized and configured to accommodate the pin member 76. As best seen in FIG. 18, the apertures disposed within the brace members 74 are adapted to be coaxially aligned when the middle portions are overlapped, thus allowing the overlapped middle portions of the brace members 74 of each pair to be extended over a respective end of the pin member 76. After a washer 75 is positioned over each end of the pin member 76 fasteners such as cotter pins 79 are extended through each of the apertures 77, thus maintaining the brace members 74 of each pair in rigid attachment to the opposite sides of the central post 42. As will be recognized, the distance separating each aperture 77 from a corresponding side of the central post 42 when the pin member 76 is extended therethrough is approximately equal to the total thickness of the overlapped brace members 74 of each pair.

To facilitate the extension of the overlapped middle portions of the brace members 74 over the ends of the pin member 76 and the insertion of the cotter pins 79 into the apertures 77, the first and second layers 56, 58 of each wall section 46 are preferably provided with pre-formed, diamond-shaped center knock-outs 81 for accessing the overlapped middle portions. As will be recognized, since a pair of brace members 74 are extended into each of the two opposed pairs of channels 72 defined between the first, second and middle layers 56, 58, 62, the center knock-outs 81 formed in the first and second layers 56, 58 of a selected wall section 46 will be removed to permit access to the overlapped middle portions.

In addition to the center knock-outs 81, the first and second layers 56, 58 of each wall section 46 are preferably provided with a pre-formed, diamond-shaped lower knock-out 83 for accessing the lower ends of the brace members 74 of each pair. Since the lower ends of each pair of brace members 74 are rigidly attached to opposite sides of the first and third posts 42 adjacent the bottom ends thereof, the lower knock-outs 83 formed in the first and second layers 56, 58 of the wall sections 46 will be removed to permit access to the lower ends.

In the preferred embodiment, the brace members 74 are inserted into both pairs of channels 72 defined within three successive wall sections 46, and subsequently attached to the wall frame 38 in the aforementioned manner. The brace members 74 are always inserted into both pairs of channels 72 to prevent any uneven deflection of the wall structure 36 when placed under extreme lateral loads. Typically, the opposed pairs of brace members 74 are attached to the wall frame 38 only at the corners of the residential structure 10. However, the wall structure 36 may include one or a multiplicity of opposed brace member pairs attached to the wall frame 38 in end-to-end fashion or spaced relation, with the number of brace member pairs being selected based on the desired degree of rigidity and structural integrity to be imparted to the wall structure 36.

As will be recognized from the aforementioned construction process, when the wall structure 36 is erected, the foam wall sections 46 are entrapped by the posts 42, track 40, header beam segments 44, and brace members 74, thus becoming an integral part of the wall structure 36. Advantageously, the outer surfaces of the wall sections 46, and more particularly the first and second layers 56, 58 thereof provide uniform surfaces to which may be applied final wall finishes. Importantly, the extension of the foam wall sections 46 outward from both sides of the post 42, the interlock of the wall sections 46 facilitated by the overlap of the vertical tongues 66 and vertical slot 68, and the extension of the brace members 74 through the channel 72 and attachment thereof to the wall frame 38, provides the wall sections 46 with compressive strength to resist shear and with substantial wind load resistance. In this respect, by entrapping the foam wall sections 46 between the track 40, posts 42 and header beam 44, and attaching the brace members 74 to the wall frame 38, the shear strength capability and seismic resistance of the wall sections 46 and resultant wall structure 36 is maximized due to the physical interaction of the components. The incorporation of the brace members 74 into the wall structure 36 provides the wall structure 36 with the required shear strength value called for by most building codes, even without other materials such as plywood being clad to the inner or outer surfaces of the wall sections 46. Additionally, the aforementioned manner of construction eliminates slop and prevents moisture deterioration. Due to the foam core of the wall structure 36 imparted by the utilization of the wall sections 46, the thermal, acoustical and insulation qualities of the wall structure 36 are maximized and provide the necessary moisture barrier, resulting in a rigid, flat, smooth, square and plumb structure.

Referring now to FIGS. 6, 8, 9 and 26, the first and middle layers 56, 62 of each wall section 46 may include a pair of electrical component knock-outs 76 formed therein. In the preferred embodiment, one of the knock-outs 76 is formed intermediate the upper and lower edges of the wall section 46, with the other knock-outs 76 being formed in closer proximity to the lower edge of the wall section 46. In addition to the knock-outs 76, the second and middle layers 58, 62 of each wall section 46 may themselves include a pair of electrical component knock-out 76*a* formed therein in the same relative orientations as the knock-outs 76. The removal of the knock-outs 76 from within the first and middle layers 56, 62 facilitates the formation of recesses 78 within the wall section 46 which are sized to accommodate components such as electrical switches and electrical outlet boxes. As will be recognized, the recesses 78 are formed within both the first and middle layers 56, 62 to provide the depth needed to fully receive the aforementioned electrical components. Similarly, the removal of the knock-outs 76*a* from within the second and middle layers 58, 62 likewise facilitates the formation of the recesses 78 within the wall section 46. Electrical conduits 80 may also be formed in the first or second layers 56, 58 of the wall section 46 via the utilization of a tool such as a hot knife, though other forming methods may also be utilized. The formation of the electrical conduits 80 through the use of the hot knife occurs in the field subsequent to the assembly of the wall structure 36. Through the use of the hot knife, other recesses and conduits 80 may be formed in the wall sections 46 for facilitating the emplacement of a plumbing manifold into the wall structure 36. Advantageously, the foam overlay of the wall sections 46 facilitated by the vertical slots 68 allows for the emplacement of the plumbing and electrical systems into the wall sections 46 only and eliminates the need to cut through the posts 42 and/or lower header beam 44.

Referring now to FIGS. 14–17, in accordance with a second embodiment of the present invention, the wall structure 36 may be fabricated through the utilization of brace members 74*a*, each of which comprise identically configured upper and lower brace segments 82, 84. As seen in FIG. 15, the upper and lower brace segments 82, 84 each define opposed ends with a pre-formed aperture 86 being disposed adjacent one end and an elongate slot 88 being disposed adjacent the opposite end. In the preferred embodiment, a first pair of brace members 74*a* (with each brace member 74*a* comprising upper and lower brace segments 82, 84) is slidably inserted into one of the two sets of channels 72 defined within three successive wall sections 46 with a second pair of brace members 74*b* being slidably inserted into the other set of channels 72. The attachment of the brace members 74*a*, 74*b* to the wall frame 38 is facilitated by the rigid attachment of the upper ends of the upper brace segments 82 of each pair to opposite sides of the lower header beam segments 44 adjacent the top ends of the first and third posts 42. Such attachment is facilitated by the extension of fasteners such as screws through the apertures 86 of the upper brace segments 82 and into the lower header beam segments 44. Similarly, the lower ends of the lower brace segments 84 of each pair are rigidly attached to opposite sides of the first and third posts 42 adjacent the bottom ends thereof via the extension of screws through the apertures 86 thereof and into the posts 42. As will be recognized, selected ones of the lower knock-outs 83 disposed within the wall sections 46 are removed to facilitate the attachment of the lower ends of the lower brace segments 84 of each pair to opposite sides of the first and third posts 42. Importantly, the upper and lower brace segments 82, 84 of the brace members 74*a*, 74*b* are sized such that when attached to the posts 42 and header beam segments 44 in the aforementioned manner, the slots 88 of the upper and lower brace segments 82, 84 will at least partially overlap each other at the central post 42.

Similar to the attachment of the brace members 74 to the central post 42, the overlapped portions of the slots 88 of the brace members 74*a*, 74*b* are extended over the opposed ends of the pin member 76, with the washers 75 being positioned over the ends of the pin member 76 and the cotter pins 79 subsequently being inserted into the apertures 77. The extension of the pin member 76 through the slots 88 and subsequent insertion of the cotter pins 79 into the apertures 77 facilitates the pivotal connection of the upper and lower brace segments 82, 84 of each brace member 74*a*, 74*b* to each other and to the central post 42. As will be recognized, the overlapped portions of the slots 88 and pin member 76 are accessed by removing the opposed center knock-outs 81 from the first and second layers 56, 58 of the wall section 46.

In the second embodiment, the extension of the brace members 74*a*, 74*b* over the pin member 76 preferably occurs prior to the attachment of the upper ends of the upper brace segments 82 to the header beam segments 44 and the attachment of the lower ends of the lower brace segments 84 to the first and third posts 42. Subsequent to the extension of the pin member 76 through the overlapped slots 88 of the brace members 74*a*, 74*b*, the upper brace segments 82 of each pair are pulled upwardly prior to being attached to the header beam segments 44 such that the pin member 76 is abutted against the arcuate end of each slot 88 which is disposed closest to the lower ends of the upper brace segments 82. Similarly, the lower brace segments 84 of each pair are pulled downwardly prior to being attached to the first and third posts 42 such that the pin member 76 is abutted against the arcuate end of each slot 88 which is disposed closest to the upper ends of the lower brace segments 84. As best seen in FIGS. 16 and 17, the ends of each slot 88 which are disposed closest to the lower ends of the upper brace segments 82 and the upper ends of the lower brace segments 84 have an enlarged or flared configuration. In particular, the diameters of the flared ends of the slots 88 exceed the diameters of the opposed, non-flared ends thereof by approximately one-fourth of an inch.

Advantageously, the engagement of the upper and lower brace segments 82, 84 to the pin member 76 in the aforementioned manner allows the upper and lower brace segments 82, 84 of each brace member 74*a*, 74*b* to move toward each other in the manner shown by the arrows in FIG. 17. Such movement prevents either of the brace members 74*a*, 74*b* of each of the two pairs from buckling when a shear force is applied to the wall structure 36, i.e., the header beam segments 44, the header beam 45 and track 40 move longitudinally in opposite directions. Additionally, when the upper and lower brace segments 82, 84 move toward each other in the manner shown, they will also rotate slightly about the pin member 76. Importantly, the formation of the slots 88 with the enlarged ends eliminates any binding of the upper and lower brace segments 82, 84 upon the pin member 76 when such rotation occurs. As will be recognized, the brace members 74 constructed in accordance with the first embodiment are more susceptible to such buckling when a shear force is applied to the wall structure 36 due to the overlapped portions thereof being rigidly attached to the central post 42. Such buckling of the brace members 74 may cause the disengagement of either the first or second layers 56, 58 from the middle layer 62 and resultant damage to the wall structure 36. As such, the incorporation of the brace members 74*a*, 74*b* into the wall structure 36 increases the ability of the wall structure 36 to withstand seismic activity without damage. Typically, when the upper and lower brace segments 82, 84 of a brace member 74*a*, 74*b* move toward each other in the manner shown, the upper and lower brace segments 82, 84 of the other brace member 74*a*, 74*b* of each pair will remain in abutted engagement to the pin member 76.

Referring now to FIG. 1, windows may be formed in the wall structure 36 via the utilization of a sill member 92 and a jam member 94, each of which are interfaced to the posts 42 via pairs of window brackets. The sill and jam members 92, 94 are horizontally oriented between and secured to a pair of posts 42. The window may be constructed having a multitude of different heights and, by cutting our central portions of one or more interior posts 42, may be constructed having any number of desired widths. As such, when a window is formed within a wall structure 36, one or more wall sections 46 must also be cut to accommodate the window. Similar methods are utilized to form doors within the wall structure.

Referring now to FIGS. 23 and 24, the wall structure 36 constructed in accordance with either the first or second embodiments may incorporate plural wall sections 200 as an alternative to the previously described wall sections 46. Each wall section 200 comprises a rectangularly configured, unitary block which is preferably fabricated from polystyrene foam. Like the wall sections 46, each wall section 200 defines a vertical tongue 202 extending along a first vertical edge portion thereof, and a generally U-shaped vertical slot 204 extending along a second vertical edge portion thereof. In addition to the vertical tongue 202 and vertical slot 204, the wall section 200 defines a horizontal slot 206 extending along a horizontal upper edge portion thereof which is sized to receive the lower header beam 44, and a pair of parallel grooves 207 extending along a lower horizontal edge portion thereof for receiving the opposed side walls 50 of the track 40.

The wall section 200 further defines two sets of elongate, diagonally extending channel segments 208 which are sized and configured identically to the two sets of channel segments defined within each wall section 46. However, as seen in FIG. 23, since the wall section 200 comprises a unitary block rather than three (3) independent layers which are adhesively secured to each other, the channel segments 208 of each set are formed within the wall section 200 via the utilization of a hot knife tool 210. In particular, one set of the channel segments 208 is formed by inserting the cutting portion of the hot knife tool 210 into the inner surface 212 of the wall section 200 to a depth of approximately 2 inches (which is approximately one-third of the total thickness of the wall section 200). Thereafter, the hot knife tool 210 is moved in the manner illustrated by the arrows shown in FIG. 23 so as to form a single, diagonally extending channel segment 80 of the set. The channel segment 80 is formed by the removal of an elongate foam slug from within the wall section 200 which is created by the cutting procedure. Importantly, due to the manner in which the hot knife tool 210 is moved during the formation of the channel segment 80, only a single incision having a width of approximately 0.004 to 0.005 inches is formed within the inner surface 212. Additional channel segments 208 of the first set are formed in a like manner, with the other set of channel segments 80 being formed by the selective insertion of the hot knife tool 210 into the outer surface of the wall section 200 in the same manner previously described. In addition to being utilized to form each set of channel segments 208, the hot knife tool 210 is also used to cut the unitary foam block in a manner defining the vertical tongue 202, vertical slot 204, horizontal slot 206 and parallel slots. Advantageously, due to the fabrication of the wall section 200 from the unitary foam block and subsequent formation of the channel segments 208 therewithin via the utilization of the hot knife tool 210, the wall structure 36 incorporating the wall sections 200 is less susceptible to seismic damage. In this respect, though the buckling of the brace members 74 or 74*a*, 74*b* may cause the disengagement of either the first or second layers 56, 58 of the wall section 42 from the middle layer 62 thereof, such buckling would not cause any damage to the wall section 200 due to its unitary construction.

Referring now to FIGS. 22*a* and 22*b*, each wall section 200 may also include one or more electrical component knock-outs 214 formed therewithin. Each knock-out 214 is preferably formed through the utilization of a hot knife tool 216. As seen in FIG. 22*a*, the hot knife tool 216 is inserted into the inner surface 212 of the wall section 200 to a depth of approximately 4" (which is approximately two-thirds of the total thickness of the wall section 200) and moved laterally as illustrated by the arrow so as to form a generally U-shaped cut. Thereafter, the hot knife tool 216 is moved in a reverse sequence so that only the U-shaped cut is formed in the inner surface 212 when the hot knife tool 216 is removed from within the wall section 200. As seen in FIG. 22*b*, a second generally U-shaped cut is formed in the wall section 200 in the same manner previously described, with the second cut being a mirror image of the first cut. As will be recognized, the first and second cuts, in combination, define the knock-out 214. Though not shown, the wall section 200 may be provided with lower and center knock-outs in a like manner.

ROOF AND CEILING STRUCTURES

Figure 19:
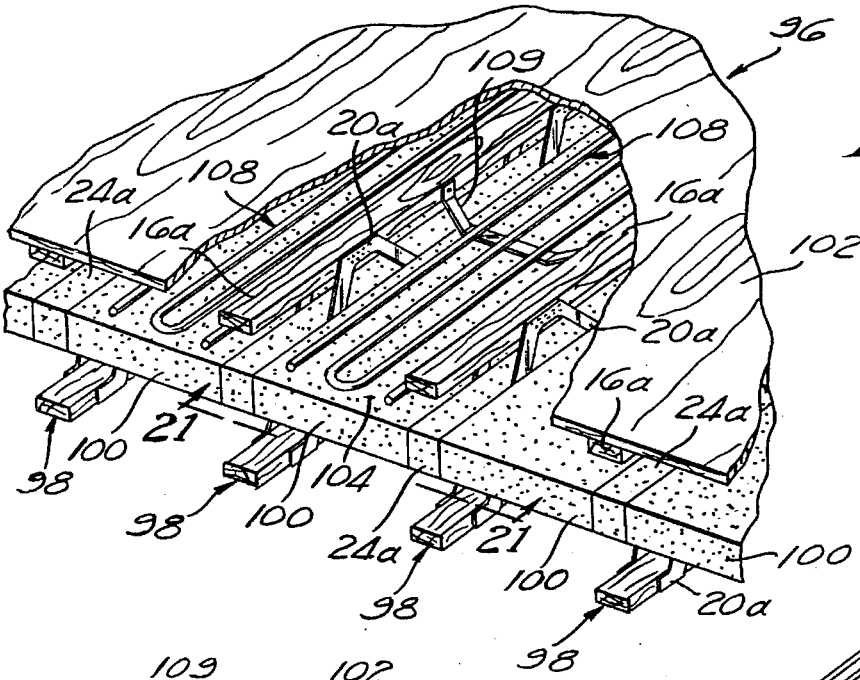
FIG. 19 is a cutaway perspective view of the ceiling structure of the present invention.

Referring now to FIGS. 1 and 19, the building system of the present invention further comprises a roof structure 96 and a ceiling structure 97 which are identically configured and formed in substantially the same manner as the floor structure 12. In the preferred embodiment, the roof and ceiling structures 96, 97 comprises a plurality of roof/ceiling trusses 98 which are attached to the header beam 44 of the wall structure 36 and extend in spaced, parallel relation. The header beam 44 is preferably pre-drilled to facilitate the proper alignment and positioning of the roof/ceiling trusses 98. Each of the roof/ceiling trusses 98 is configured identically to the floor joists 14 and assembled in the same manner as previously described in relation to the floor joists 14.

Disposed between each pair of adjacent roof/ceiling trusses 98 is a pre-fabricated roof/ceiling section 100 which, like the floor sections 28, is preferably fabricated from polystyrene foam. The roof/ceiling sections. 100 are configured identically to the floor sections 28, and are each rigidly maintained between an adjacent pair of roof/ceiling trusses 98 in the same manner each floor section 28 is captured between an adjacent pair of floor joists 14. As such, when a roof/ceiling section 100 is captured between a pair of roof/ceiling trusses 98, the upper plane of the roof/ceiling section 100 is flush with the top surfaces of the insert members 24*a* of the roof/ceiling trusses 98.

In the preferred embodiment, the roof and ceiling structures 96, 97 are constructed in the same manner by which the floor structure 12 is constructed. Initially, a first roof/ceiling truss 98 is attached to the upper header beam 45, with a first longitudinally extending edge portion of a roof/ceiling section 100 being abutted against and adhesively secured to a truss member 20*a* and insert member 24*a* of the first roof/ceiling truss 98. A second roof/ceiling truss 98 is then oriented such that a truss member 20*a* and insert member 24*a* thereof are abutted against and adhesively secured to a second longitudinally extending edge portion of the first roof/ceiling section 100, thus capturing the first roof/ceiling section 100 between the first and second roof/ceiling trusses 98. Importantly, when the first roof/ceiling section 100 is captured between the first and second roof/ceiling trusses 98, the first and second longitudinally extending edge portions of the roof/ceiling section 100 are substantially flush with the first and second roof/ceiling trusses 98 with no substantial gaps existing therebetween. Subsequent roof/ceiling sections 100 and roof/ceiling trusses 98 are added to the roof or ceiling structure 96, 97 in the aforementioned manner. In the roof structure 96, after the roof trusses 98 and roof sections 100 have been assembled, a layer of sheathing 102 is secured to the roof trusses 98, and in particular the top surfaces of the upper cords 16*a* thereof. A layer of roofing material is then applied to the layer of sheathing 102.

When the sheathing 102 is applied to the upper cords 16*a* of the roof trusses 98, longitudinally and laterally extending spaces 104 are defined between the sheathing 102 and the top surfaces of the roof sections 100 and insert members 24*a*. The spaces 104 form air pathways for ventilating and cooling the roof surface when eave and ridge vents are installed. Advantageously, flat, shed and gabled roofs are easily designed utilizing the roof structure 96 of the present invention. As can be appreciated, ventilation of the roof structure 96 facilitated by the creation of the air pathways carries off heat and prevents heat buildup on the roof surface, thus extending the life of the layer of roofing. Additionally, fresh air introduction and circulation within the roof structure 96 is provided by a natural chimney effect without electric fans and without comprising the insulation. Similarly, when a layer of ceiling material is applied to the lower cords 16*b* of the ceiling trusses 98, longitudinally and laterally extending spaces are defined between the ceiling material and the bottom surfaces of the ceiling sections 100 and insert members 24*a*. These spaces define air plenums which create dead air space for added insulation and may also serve as ducting or electrical/plumbing service conduits.

Figure 21:
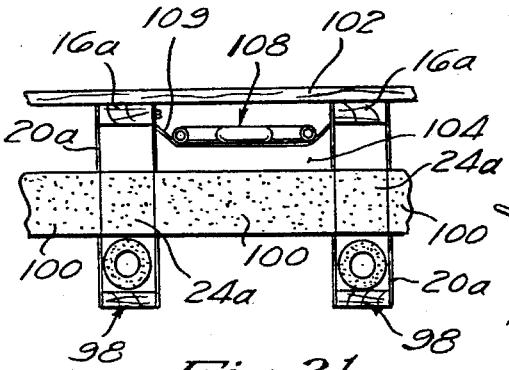
FIG. 21 is a cross-sectional view taken along line 21—21 of FIG. 19.
Figure 20:
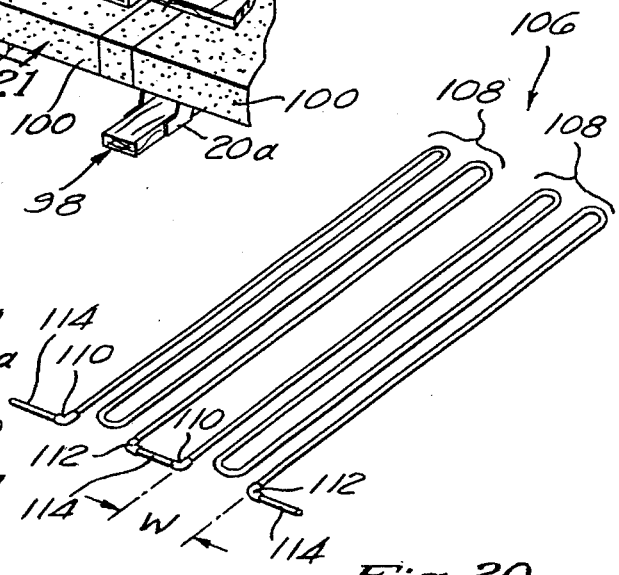
FIG. 20 is a perspective view of a solar water heating system incorporated into the ceiling structure shown in FIG. 19.

Referring now to FIGS. 19–21, the roof structure 96 constructed in accordance with the present invention may further include a solar water heating system 106 incorporated thereinto. The water heating system 106 comprises one or more pipe sections 108, each of which has a serpentine configuration and includes an inlet port 110 and an outlet port 112 disposed at a common side. In the preferred embodiment, each of the pipe sections 108 is formed having a width W which is sized to allow a pipe section 108 to be inserted into a longitudinally extending space 104 (i.e., between the top surface of a roof section 100 and the sheathing 102 and between the truss members 20*a* of an adjacent pair of roof trusses 98). As best seen in FIG. 21, each pipe section 108 is maintained within a respective longitudinally extending space 104 by resting the same upon hanger brackets 109 attached to and extending between the upper cords 16*a* of an adjacent pair of roof trusses 98. In this respect, the hanger brackets 109 are specifically configured so as to suspend the pipe section 108 equidistantly between the sheathing 102 and roof section 100, and equidistantly between the truss members 20*a* of the adjacent pair of roof trusses 98. The inlet and outlet ports 110, 112 of the one or more serpentine pipe sections 108 incorporated into the roof structure 96 are interconnected in series via a plurality of pipe segments 114.

Due to the modular construction of the water heating system 106 facilitated by the use of the independent pipe sections 108, any pipe section 108 of the water heating system 106 which subsequently develops a leak may be removed and replaced simply by disconnecting the inlet and outlet ports 110, 112 from the pipe segments 114, thus eliminating the need to remove the entire water heating system 106 from within the roof structure 96. In this respect, the damaged pipe section 108 is simply slid out from within the longitudinal space 104 into which it is inserted, and replaced with a substitute pipe section 108, the inlet and outlet ports 110, 112 of which are fluidly coupled to the pipe segments 114. Due to the serpentine configuration of the pipe sections 108 and the excessive heating which occurs in the spaces 104, particularly on summer days, the water heating system 106 provides a significant elevation in the temperature of the water passed therethrough. As will be recognized, the greater the number of pipe sections 108 incorporated into the water heating system 106, the greater the resultant rise in the temperature of the water passed through the water heating system 106. To facilitate optimal heat transfer from the spaces 104 into the flowing water, the pipe sections 108 as well as the pipe segments 114 are preferably fabricated from copper or PVC. The solar water heating system 106 presents an advantage over prior art solar water heating systems which are typically placed directly upon the roofing since the same is completely concealed from the elements (and thus less susceptible to UV damage) and does not harm the roofing in any manner. Additionally, by placing the pipe sections 108 within the spaces 104, solar heating efficiency is increased due to the heating achieved via the chimney effect.

Due to the manner in which the floor structure 12, wall structure 36 and roof and ceiling structures 96, 97 of the present invention are pre-fabricated, all wall, flooring, roof and ceiling portions of the residential structure 10 may be assembled utilizing only screw fasteners and a drill. Advantageously, the floor, wall, roof and ceiling structures of the present invention are formed of selected materials capable of maintaining tolerances (i.e., precision location for ease of assembly). Due to the dimensional stability associated with the track 40, posts 42, and header beam 44, as well as the interlocking overlay of the wall sections 46, the residential structure 10 may be constructed with unskilled labor in a minimal amount of time and with a minimal amount of difficulty. In this respect, in fabricating the wall structure 36, one post 42 may be first plumbed with all other posts 42 being subsequently automatically plumbed due to the dimensional stability associated with the flanges 52 of the track 40. Further, the manner of forming the floor, wall, roof and ceiling structures of the present invention promotes increased resistance to shear and enhanced seismic stability due to the formation of monolithic structures which take advantage of the compressive strength of the foam components thereof. The seismic stability of the wall structure 36 is further enhanced by the inclusion of the brace members 74, 74*a*, 74*b* therewithin.

Additional modifications and improvements of the present invention may also be apparent to those skilled in the art. Thus, the particular combination of parts described and illustrated herein is intended to represent only one embodiment of the invention, and is not intended to serve as limitations of alternative devices within the spirit and scope of the invention.

What is claimed is:

1. An improved building system including a dimensionally stable, monolithic wall structure, said wall structure comprising:

a wall frame comprising:

an elongate track extended along and attached to a horizontal foundation means;

a plurality of elongate, vertical posts of predetermined lengths having top and bottom ends, said bottom ends being attached to said track at predetermined locations along the length thereof; and at least one elongate, horizontal header beam attached to the top ends of said posts;

a plurality of pre-fabricated wall sections, each of said wall sections being disposed between a pair of adjacent posts of the wall frame and including first and second vertical edge portions which abut the posts of the post pair; and at least two pairs of elongate brace members attached to said wall frame in opposed relation, said brace members of each pair extending diagonally between said track and said header beam and through at least two adjacent wall sections in a generally X-shaped configuration;

wherein the abutment of said first and second vertical edge portions against the posts of the post pair and the attachment of the brace members to the wall frame produces a synergistic effect by utilizing the compressive, tensile and sheer force properties of said wall frame and said wall sections, thus forming a monolithic wall structure.

2. The building system of claim 1 wherein said brace members of each pair are extended diagonally between first and third vertical posts which are separated by a central vertical post, said brace members of each pair having upper ends rigidly attached to said header beam adjacent the top ends of said first and third vertical posts, lower ends rigidly attached to said first and third vertical posts adjacent the bottom ends thereof, and overlapped middle portions rigidly attached to said central vertical post.

3. The building system of claim 1 wherein said brace members of each pair are extended diagonally between first and third vertical posts which are separated by a central vertical post, each of said brace members comprising:

an upper brace segment defining first and second ends; and a lower brace segment defining first and second ends;

the first ends of said upper brace segments of each pair of brace members being rigidly attached to said header beam adjacent the top ends of said first and third vertical posts, the first ends of said lower brace segments of each pair of brace members being rigidly attached to said first and third vertical posts adjacent the bottom ends thereof, and the second ends of said upper and lower brace segments of each pair of brace members being pivotally connected to said central vertical post.

4. The building system of claim 1 wherein each of said wall sections includes a plurality of diagonally extending channel segments formed therein, said channel segments being oriented so as to define elongate channels which extend through adjacent wall sections for slidably receiving said brace members of each pair.

5. The building system of claim 4 wherein each of said wall sections comprises:

a first layer defining an outer surface and an inner surface having a plurality of diagonally extending slots formed therein;

a second layer defining an outer surface and an inner surface having a plurality of diagonally extending slots formed therein; and a middle layer disposed between said first and second layers and defining opposed side surfaces, the inner surfaces of said first and second layers being adhesively secured to respective ones of the side surfaces of said middle layer, and said channel segments being defined between said slots and said side surfaces.

6. The building system of claim 5 wherein the first and middle layers of each of said wall sections include at least one electrical component knock-out formed therein.

7. The building system of claim 5 wherein the first and second layers of each of said wall sections include at least one center knock-out formed therein for accessing portions of the brace members of each pair.

8. The building system of claim 5 wherein:

said middle layer defines a vertical tongue extending along the first vertical edge portion of the wall section; and said first, second and middle layers define a generally U-shaped vertical slot having an interior surface and extending along the second vertical edge portion of the wall section;

each of the wall sections being disposed between a pair of adjacent posts such that the vertical tongue abuts one of the posts of the post pair and the vertical slot receives and encapsulates the other post of the post pair and the vertical tongue of an adjoining wall section, with the post received into the vertical slot being abutted against the interior surface thereof.

9. The building system of claim 8 wherein said first, second and middle layers are each fabricated from polystyrene foam.

10. The building system of claim 8 wherein said track has a generally U-shaped configuration defining a bottom wall which is extended along and attached to said foundation means and opposing side walls extending upwardly from said bottom wall, and the first, second and middle layers further define a pair of parallel grooves extending along a lower edge portion of said wall section for receiving the opposing side walls of said track.

11. The building system of claim 10 wherein said first, second and middle layers further define a horizontal slot extending along a horizontal edge portion of the wall section for receiving at least a portion of said header beam.

12. The building system of claim 1 wherein said track is fabricated from sheet metal.

13. The building system of claim 1 wherein said vertical posts and said at least one header beam are fabricated from tubular steel and said brace members are fabricated from steel.

14. The building system of claim 1 further comprising:

a plurality of elongate floor joists attached to said foundation means and extending in parallel relation; and a plurality of pre-fabricated floor sections, each of said floor sections being disposed between a pair of adjacent joists and including first and second horizontal edge portions which abut the joists of the joist pair;

wherein the abutment of said first and second horizontal edge portions against the joists of the joist pair produces a synergistic effect by utilizing the compressive, tensile and shear force properties of said joists and said floor sections, thus forming a monolithic floor structure.

15. The building system of claim 14 wherein each of said floor joists-comprises:

an elongate upper cord defining opposed longitudinal edges;

an elongate lower cord defining opposed longitudinal edges;

a pair of truss members rigidly attached to and extending between corresponding ones of the longitudinal edges in a manner orienting said upper and lower cords in spaced, parallel relation; and an insert member disposed between said upper and lower cords and said truss members.

16. The building system of claim 15 wherein each of said truss members includes a multiplicity of elongate, arcuately contoured extensions formed therein which are adapted to engage the insert member and prevent any movement thereof between the upper and lower cords and the truss members.

17. The building system of claim 15 wherein said upper and lower cords are fabricated from wood, said truss members are fabricated from steel and said floor sections and said insert member are fabricated from polystyrene foam.

18. The building system of claim 1 further comprising:

a plurality of roof trusses attached to said header beam and extending in parallel relation; and a plurality of pre-fabricated roof sections, each of said roof sections being disposed between a pair of adjacent roof trusses and including first and second longitudinally extending edge portions which abut the trusses of the truss pair;

wherein the abutment of said first and second longitudinally extending edge portions against the trusses of the truss pair produces a synergistic effect by utilizing the compressive, tensile and shear force properties of said trusses and said roof sections, thus forming a monolithic roof structure.

19. The building system of claim 18 wherein each of said roof trusses comprises:

an elongate upper cord defining opposed longitudinal edges;

an elongate lower cord defining opposed longitudinal edges;

a pair of truss members rigidly attached to and extending between corresponding ones of the longitudinal edges in a manner orienting said upper and lower cords in spaced, parallel relation; and an insert member disposed between said upper and lower cords and said truss members.

20. The building system of claim 19 wherein each of said truss members includes a multiplicity of elongate, arcuately contoured extensions formed therein which are adapted to engage the insert member and prevent any movement thereof between the upper and lower cords and the truss members.

21. The building system of claim 19 wherein said upper and lower cords are fabricated from wood, said truss members are fabricated from steel, and said ceiling sections and said insert member are fabricated from polystyrene foam.

22. The building system of claim 1 wherein said wall structure includes a multiplicity of brace member pairs attached to said wall frame in spaced relation.

23. A method of forming a monolithic wall structure from a wall frame, interlocking foam wall sections, and at least one pair of brace .members, wherein a synergistic effect is achieved utilizing the compressive, tensile and shear force properties of the wall frame and wall sections, comprising the steps of:

(a.) attaching an elongate track to a horizontal foundation means;

(b.) attaching the bottom end of a first post to the foundation at a predetermined location along the track via a first pre-fabricated registration means;

(c.) disposing a first pre-fabricated wall section upon said track in a manner wherein a vertical slot formed within a first vertical edge portion of the first wall section encapsulates said first post, with said first post being abutted against an interior surface of said vertical slot;

(d.) securing the bottom end of a second post to the foundation at a predetermined location along the track via said first registration means in a manner wherein said second post is abutted against a vertical tongue formed along a second vertical edge portion of said first wall section;

(e.) disposing a second wall section upon said track in a manner wherein a vertical slot formed within a first vertical edge portion of the second wall section receives and encapsulates the second post and the vertical tongue of the first wall section, with the second post being abutted against an interior surface of the vertical slot formed within the second wall section;

(f.) securing the bottom end of a third post to the foundation at a predetermined location along the track via said first registration means in a manner wherein said third post is abutted against a vertical tongue formed along a second vertical edge portion of said second wall section;

(g.) securing at least one elongate, horizontal header beam to the top ends of the posts via a second prefabricated registration means;

(h.) extending two pairs of elongate brace members through complimentary pairs of channels disposed within said first and second wall sections in opposed relation and extending between said header beam and said track in a generally X-shaped configuration; and (i.) attaching said brace members of each pair to said wall frame.

24. The method of claim 23 wherein step (i.) further comprises the steps of:

attaching the upper ends of said brace members of each pair to said header beam adjacent the top ends of said first and third posts;

attaching the lower ends of said brace members of each pair to said first and third posts adjacent the bottom ends thereof; and attaching the overlapped middle portions of said brace members of each pair to said second post.

25. The method of claim 23 wherein each of said brace members comprises an upper brace segment defining first and second ends and a lower brace segment defining first and second ends, and the step (i.) further comprises the steps of:

attaching the first ends of said upper brace segments of each pair of brace members to said header beam adjacent the top ends of said first and third posts;

attaching the first ends of said lower brace segments of each pair of brace members to said first and third posts adjacent the bottom ends thereof; and pivotally connecting the second ends of said upper and lower brace segments to said second post.

26. The method of claim 23 further comprising the steps of plumbing the first post and subsequently plumbing the second and third posts due to the dimensional stability of the first and second registration means.

27. The method of claim 23 wherein forming said wall structure utilizes solely self-tapping screw fasteners and a drill motor hand tool.

28. The method of claim 23 further comprising the step of placing a plumbing manifold and electrical system into said wall sections without cutting through said posts, said header beam and said brace members.

29. The method of claim 23 further comprising the step of forming a monolithic floor structure utilizing a floor frame and pre-fabricated foam floor sections wherein a synergistic effect is achieved utilizing the compressive, tensile and sheer force properties of the floor frame and floor sections.

30. The method of claim 29 wherein the formation of the floor structure comprises the steps of:

(a.) attaching a first floor joist to said foundation means;

(b.) adhesively securing a first horizontal edge portion of a first pre-fabricated floor section to the first joist; and (c.) attaching a second floor joist to the foundation means and adhesively securing the second floor joist to a second horizontal edge portion of the first floor section.

31. The method of claim 30 wherein step (a.) further comprises the step of forming each of the floor joists by:

attaching a pair of truss members to corresponding ones of the longitudinal edges of upper and lower beams such that the upper and lower beams extend in spaced, parallel relation and are separated by said truss member; and placing an insert member between said upper and lower beams and said truss members.

32. The method of claim 23 further comprising the step of forming a monolithic roof structure utilizing a roof frame and pre-fabricated foam roof panels wherein a synergistic effect is achieved utilizing the compressive, tensile and shear force properties of the roof frame and roof panels.

33. The method of claim 32 wherein the formation of the roof structure comprises the steps of:

(a.) attaching a first roof truss to said header beam;

(b.) adhesively securing a first longitudinally extending edge portion of a first pre-fabricated roof section to the first roof truss; and (c.) attaching a second roof truss to the header beam and adhesively securing the second roof truss to a second longitudinally extending edge portion of the first roof section.

34. The method of claim 33 wherein step (a.) further comprises the step of forming each of the roof trusses by:

attaching a pair of truss members to corresponding ones of the longitudinal edges of upper and lower cords such that the upper and lower cords extend in spaced, parallel relation and are separated by said truss member; and placing an insert member between said upper and lower cords and said truss members.

35. The method of claim 30 further comprising the step of attaching a layer of plywood to the floor joists.

36. The method of claim 23 further comprising the steps of:

(j.) extending a sill member horizontally between a pair of posts and attaching the sill member to each post of the post pair; and (k.) extending a jam member horizontally between the pair of posts in an orientation above said sill member and attaching the jam member to the posts;

said adjacent posts, said sill member and said jam member forming a window in said wall frame.

37. The method of claim 33 further comprising the step of attaching a layer of sheathing to the roof trusses.

38. The method of claim 37 further comprising the step of cutting selected ones of said wall sections in a manner wherein said wall sections do not obstruct the window formed by said adjacent posts, said sill member and said jam member.

39. The building system of claim 5 wherein the first and second layers of each of said wall sections include at least one lower knock-out formed therein for accessing portions of the brace members of each pair.

40. The building system of claim 15 wherein the first and second horizontal edge portions of each of said floor sections is secured to a truss member and insert member of each floor joist of an adjacent pair of floor joists via the use of an adhesive material, said adhesive material creating a radon gas seal in the floor structure.

41. The building system of claim 18 further comprising at least one serpentine pipe section disposed between a pair of adjacent roof trusses, said pipe section defining inlet and outlet ports which are interconnected by a main water pipe and being utilized to heat water flowing therethrough due to the heat transfer facilitated by the air current between the roof trusses.

42. The method of claim 37 further comprising the steps of:

(d.) placing a serpentine pipe section upon said first roof section beneath said layer of sheathing and between said first and second roof trusses;

(e.) attaching a main water pipe to inlet and outlet ports of the pipe section; and (f.) circulating water through said main water pipe and said pipe section.

43. The building system of claim 4 wherein each of said wall sections defines a vertical tongue extending along the first vertical edge portion of the wall section and a generally U-shaped vertical slot having interior surface and extending along the second vertical edge portion of the wall section, each of the wall sections being disposed between a pair of adjacent posts such that the vertical tongue abuts one of the posts of the post pair and the vertical slot receives and encapsulates the other post of the post pair and the vertical tongue of an adjoining wall section, with the post received into the vertical slot being abutted against the interior surface thereof.

44. The building system of claim 43 wherein each said wall section is fabricated from polystyrene foam.

45. The building system of claim 43 wherein each of said wall sections includes at least one electrical component knock-out formed therein.

46. The building system of claim 41 further comprising a plurality of serpentine pipe sections disposed between respective pairs of adjacent roof trusses, each of said pipe sections comprising a replaceable module of a solar water heating system.

* * * * *